US008469115B2

(12) United States Patent
Kondo et al.

(10) Patent No.: US 8,469,115 B2
(45) Date of Patent: Jun. 25, 2013

(54) ELECTRICAL POWER TOOL

(75) Inventors: Tomoyuki Kondo, Anjo (JP); Yoshitaka Ichikawa, Anjo (JP); Katsuna Hayashi, Anjo (JP)

(73) Assignee: Makita Corporation, Anjo-Shi (JP)

( * ) Notice: Subject to any disclaimer, the term of this patent is extended or adjusted under 35 U.S.C. 154(b) by 283 days.

(21) Appl. No.: 13/122,068

(22) PCT Filed: Oct. 2, 2009

(86) PCT No.: PCT/JP2009/067233

§ 371 (c)(1),
(2), (4) Date: Apr. 11, 2011

(87) PCT Pub. No.: WO2010/041600

PCT Pub. Date: Apr. 15, 2010

(65) Prior Publication Data

US 2011/0232933 A1 Sep. 29, 2011

(30) Foreign Application Priority Data

Oct. 10, 2008 (JP) ..... 2008-264053
Apr. 1, 2009 (JP) ..... 2009-089340

(51) Int. Cl.
*B25B 23/14* (2006.01)

(52) U.S. Cl.
USPC ..... 173/178; 173/2; 173/48; 173/216; 173/217; 475/263; 475/298

(58) Field of Classification Search
USPC ..... 173/2, 176, 178, 117, 47, 48, 216, 173/217, 29; 475/298, 263, 275, 317
See application file for complete search history.

(56) References Cited

U.S. PATENT DOCUMENTS

| | | | | |
|---|---|---|---|---|
| 5,711,739 | A * | 1/1998 | Hashimoto et al. | 475/254 |
| 5,967,934 | A | 10/1999 | Ishida et al. | |
| 6,431,289 | B1 * | 8/2002 | Potter et al. | 173/47 |
| 6,676,557 | B2 * | 1/2004 | Milbourne et al. | 475/286 |
| 6,796,921 | B1 * | 9/2004 | Buck et al. | 475/299 |
| 6,857,983 | B2 * | 2/2005 | Milbourne et al. | 475/269 |
| 7,334,646 | B2 * | 2/2008 | Hara et al. | 173/176 |
| 7,513,845 | B2 * | 4/2009 | Ho | 475/298 |
| 7,882,899 | B2 * | 2/2011 | Borinato et al. | 173/176 |
| 7,891,641 | B1 * | 2/2011 | Miller | 254/346 |
| 7,980,324 | B2 * | 7/2011 | Bixler et al. | 173/176 |

FOREIGN PATENT DOCUMENTS

| | | |
|---|---|---|
| JP | A-06-008151 | 1/1994 |
| JP | A-09-072393 | 3/1997 |
| JP | B2-3084138 | 9/2000 |
| JP | A-2002-168311 | 6/2002 |
| JP | B2-3289958 | 6/2002 |

OTHER PUBLICATIONS

International Search Report in International Application No. PCT/JP2009/067233; dated Dec. 8, 2009 (with English-language translation).

* cited by examiner

*Primary Examiner* — Scott A. Smith
(74) *Attorney, Agent, or Firm* — Oliff & Berridge, PLC

(57) ABSTRACT

In a speed change device of an electrical power tool, a reset arm is provided separately from a switch lever, which arm is operated by a reset motor. Due to tilting motion of the reset arm, a lock ring can be returned to an unlocking position in which a second stage internal gear can be rotated, so that the speed change device can be rest to a high speed low torque mode.

5 Claims, 20 Drawing Sheets

Automatic Speed Change Mode Position

Automatic Speed Change Mode Position

High Speed Fixed Mode Position

Low Speed Fixed Mode Position

ELECTRICAL POWER TOOL

TECHNICAL FIELD

The present invention relates to an electrical power tool such as, for example, an electric screwdriver and a screw tightening machine, which mainly outputs rotative power.

BACKGROUND ART

In general, this type of electrical power tool includes a structure in which rotative power of an electric motor as a drive source is decelerated by a speed change device to output a necessary rotation torque. In many cases, a planetary gear train is used as the speed change device.

For example, in the screw tightening machine, a low torque is sufficient at the beginning of tightening, but a higher rotation torque is gradually needed as a tightening operation progresses. Therefore, a function that is required from the point of view of carrying out a quick and reliable screw tightening is to reduce a reduction ratio of the speed change device so as to output a high speed low torque at the beginning of the tightening operation, and to increase the reduction ratio of the speed change device so as to output a low speed high torque in the middle of the tightening operation. Moreover, in terms of usability, it is required that, in the middle of the tightening operation, the reduction ratio is automatically switched at a point in which a tightening resistance (an external torque) applied to an output shaft reaches a certain value.

The following Japanese Pat. No. 3289958 teaches a screw tightening machine in which a speed change device having two-stage planetary gear trains is interposed between an output shaft of an electric motor and a spindle provided with a screw tightening bit. According to the speed change device, at the beginning of a screw tightening operation, a carrier of a first stage planetary gear and a carrier of a second stage planetary gear are directly connected via an internal gear of the second stage planetary gear train. As a result, a high speed low torque is output, so that a quick screw tightening operation can be performed. When a user increases a pushing force applied to the screw tightening machine as the screw tightening operation is proceeded, the internal gear of the second stage planetary gear train is relatively displaced in an axial direction, so as to be separated from the carrier of the first stage planetary gear train, while rotation thereof is fixed, thereby causing a deceleration in the second stage planetary gear. As a result, a reduction ratio of the speed change device can be increased, so as to output a low speed high torque. Thus, a reliable screw tightening operation can be performed.

The following Japanese Patent No. 3084138 teaches a reset mechanism that functions to return a low speed high torque output condition changed by an automatic speed change to a high speed low torque output condition corresponding to an initial condition. According to the prior art reset mechanism, a speed change device can be returned to the initial condition (the high speed low torque output condition) utilizing return motion of a switch lever which motion is performed to stop operation of a main body portion. Therefore, the speed change device can be reset to the initial condition without a special manipulation by the user of the screw tightening machine.

DISCLOSURE OF THE INVENTION

Problem to be Solved by the Invention

However, according to the prior art reset mechanism, the switch lever returned to an off position presses a reset lever, so that an internal gear for speed changing can be returned to an initial position against a return spring. Therefore, the switch lever must have a biasing force that is sufficiently large enough to press the reset lever against the return spring. As a result, it is necessary to apply a large force to the switch lever in order to pull the switch lever against the large return biasing force. This may lead to decreased operability of the switch lever. Thus, there is a need in the art to provide an improved speed change device and an electrical power tool having such an improved speed change device

SUMMARY OF THE INVENTION

According to one aspect of the present invention, the rotative power of the electric motor as a drive source is changed in two stages by the speed change device having the first stage planetary gear train and the second stage planetary gear train, and is then output to the spindle. When the external torque applied to the spindle is increased, the speed change device is automatically switched to the condition in which the internal gear of the second stage planetary gear train is prevented from rotating by the internal restriction member and in which the low speed high torque is output to the spindle.

The automatically switched low speed high torque output condition is locked by the mode lock mechanism. The low speed high torque output condition can be returned to the initial condition (the high speed low torque output condition) by the reset mechanism. Unlike the conventional reset mechanism that is returned to the initial condition utilizing the return motion of the switch lever to the off position, the reset mechanism is actuated by the actuator that is separately provided as the drive source. Therefore, it is not necessary to increase a return force of the switch lever. As a result, the speed change device can be returned to the initial condition without impairing operability of the switch lever.

According to another aspect of the present invention, the reset motor as the actuator is actuated, the lock ring is returned to the unlocking side via the reset arm, so that the speed change device can be reset to the initial condition.

According to further aspect of the present invention, after the elapse of a certain period of time after the electric motor is stopped by the off-operation of the switch lever, the reset mechanism is actuated while a gear assembly constituting both of the planetary gear trains is completely stopped, so that the speed change device can be reset to a condition in which the internal gear can be rotated. Therefore, the internal gear can be avoided from meshing with the other gears during rotation (idle rotation) thereof. As a result, the speed change device can be increased in durability.

According to a further aspect of the present invention, the low speed high torque output condition of the speed change device is locked when the lock ring of the lock mechanism is shifted to the locking position. The reset mechanism can be automatically actuated when it is recognized that the lock ring is positioned in the locking position. Conversely, the reset mechanism cannot be actuated when it is not recognized that the lock ring is positioned in the locking position. Thus, the reset mechanism can be actuated when it is indirectly recognized that the speed change device is in the low speed high torque output condition by identifying the position of the lock ring. That is, the reset mechanism cannot be actuated when the speed change device is in the high speed low torque output condition. Therefore, it is possible to omit an unnecessary and useless motion of the reset mechanism (an idle motion to try to return the speed change device to the high speed low torque output condition even when the speed change device is already in the high speed low torque output condition). Thus, it is possible to quickly make the electrical power tool operational.

As described above, the reset mechanism can be actuated only when the speed change device is switched to the low speed high torque output condition. That is, the reset mechanism cannot be actuated when the speed change device is in the high speed low torque output condition, i.e., the initial condition. Therefore, for example, when the electrical power tool is tentatively rotated and is stopped in the no load condition, the reset mechanism is not actuated. As a result, the electrical power tool becomes operational immediately after tentative rotation thereof is stopped, so as to be quickly reactuated. Thus, the electrical power tool may have better usability than ever before.

The speed change device is returned from the low speed high torque output condition to the high speed low torque output condition while the reset mechanism is actuated. Therefore, the rotative power input to the speed change device is stopped in order to prevent the speed change device from being damaged. That is, the electrical power tool is deactuated while the reset mechanism is actuated. Further, for example, when the electrical power tool is tentatively rotated, the electrical power tool is deactuated, so that an actuation time of the reset mechanism can be omitted.

According to further aspect of the present invention, the sensor detects that the lock ring is positioned in the locking position and that the speed change device is in the low speed high torque output condition, so that the reset mechanism can be actuated based upon the output signal of the sensor. Therefore, the reset mechanism can be actuated only when the speed change device is switched to the low speed high torque output condition. That is, the reset mechanism cannot be actuated when there is no need to reset the speed change device, e.g., when the electrical power tool is tentatively rotated. Therefore, it is possible to omit the unnecessary and useless motion of the reset mechanism. Thus, the electrical power tool can be quickly reactuated. As a result, the electrical power tool may have the better usability than the conventional tool.

BEST MODES FOR CARRYING OUT THE INVENTION

Figure 1:
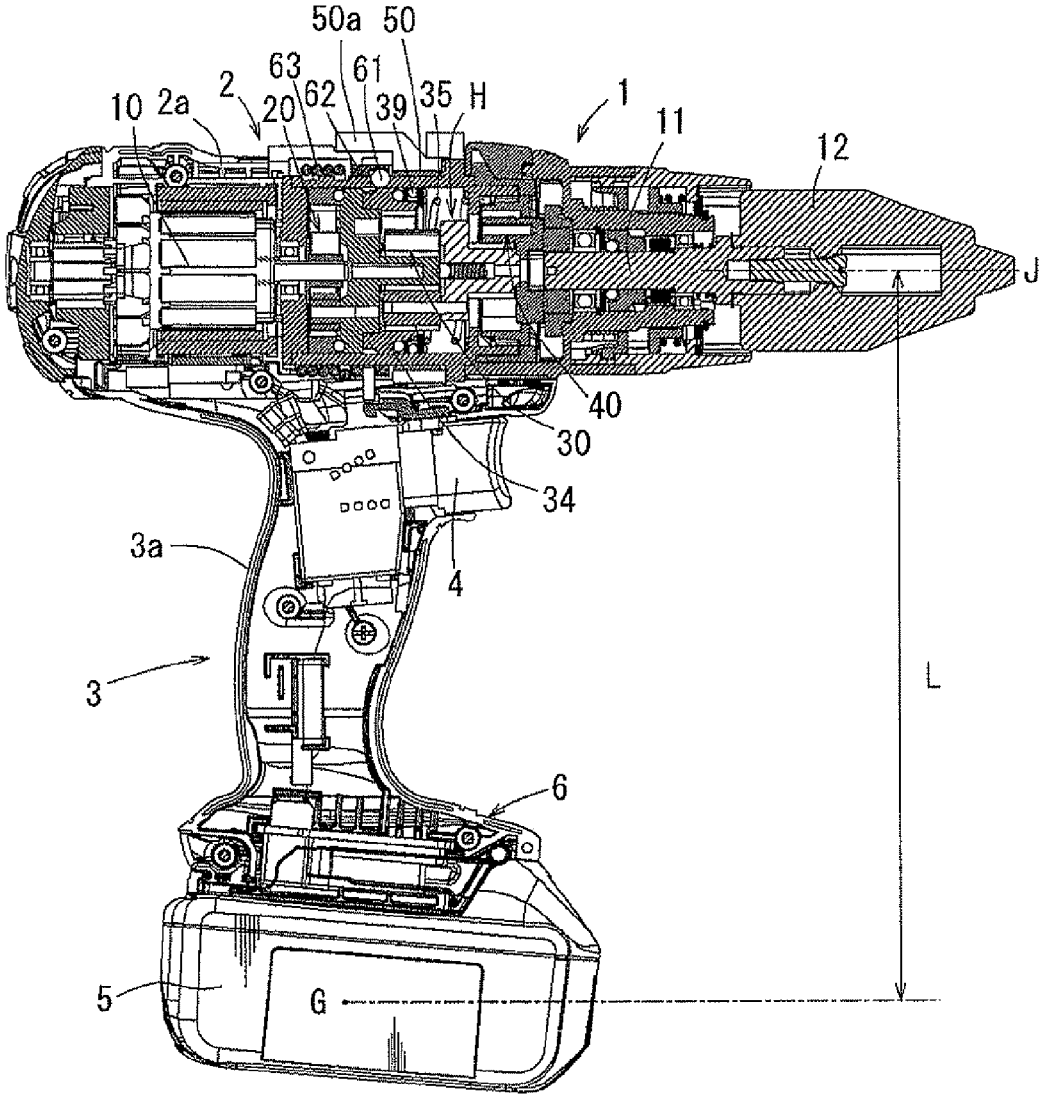
FIG. 1 is a vertical longitudinal sectional view of the whole of an electrical power tool of the present embodiment. The view shows an initial condition of a speed change device.

Next, embodiments of the present invention will be described with reference to FIGS. 1 to 12. FIG. 1 shows the whole of an electrical power tool 1 according to a first embodiment. In the embodiment, a rechargeable electric screwdriver drill is illustrated as one example of the electrical power tool 1. The electrical power tool 1 can be used as an electric screw tightening machine by attaching a screwdriver bit as an end tool. Further, the electrical power tool 1 can be used as an electric screwdriver for hole drilling by attaching a drill bit.

The electrical power tool 1 includes a main body portion 2 and a handle portion 3. The main body portion 2 has a substantially cylindrical shape. The handle portion 3 is provided to the main body portion 2 while being protruded laterally from a midpoint of the main body portion 2 in a longitudinal direction (an axial direction) thereof. Each of the main body portion 2 and handle portion 3 includes a housing that is composed of two half housings separated into right and left with respect to the axial direction (a left-right direction in FIG. 1) and matched with each other and joined together. Hereinafter, the housing of the main body portion 2 and the housing of the handle portion 3 will respectively be referred to as a main body housing 2*a* and a handle housing 3*a*, and will be distinguished from one another as necessary.

A trigger-type switch lever 4 is disposed on a front side of a proximal portion of the handle portion 3. An electric motor 10 is actuated when a user operates the switch lever 4 by triggering it with a fingertip. Also, a distal end of the handle portion 4 is provided with a battery attachment pedestal portion 6 to which a battery pack 5 is attached. The electric motor 10 is actuated by the battery pack 5 as a power source.

The electric motor 10 is incorporated in a back portion of the main body portion 2. Rotative power of the electric motor 10 is decelerated by a speed change device H having three planetary gear trains, and is then output to a spindle 11. A chuck 12 for attaching the end tool is attached to a distal end of the spindle 11.

Figure 2:
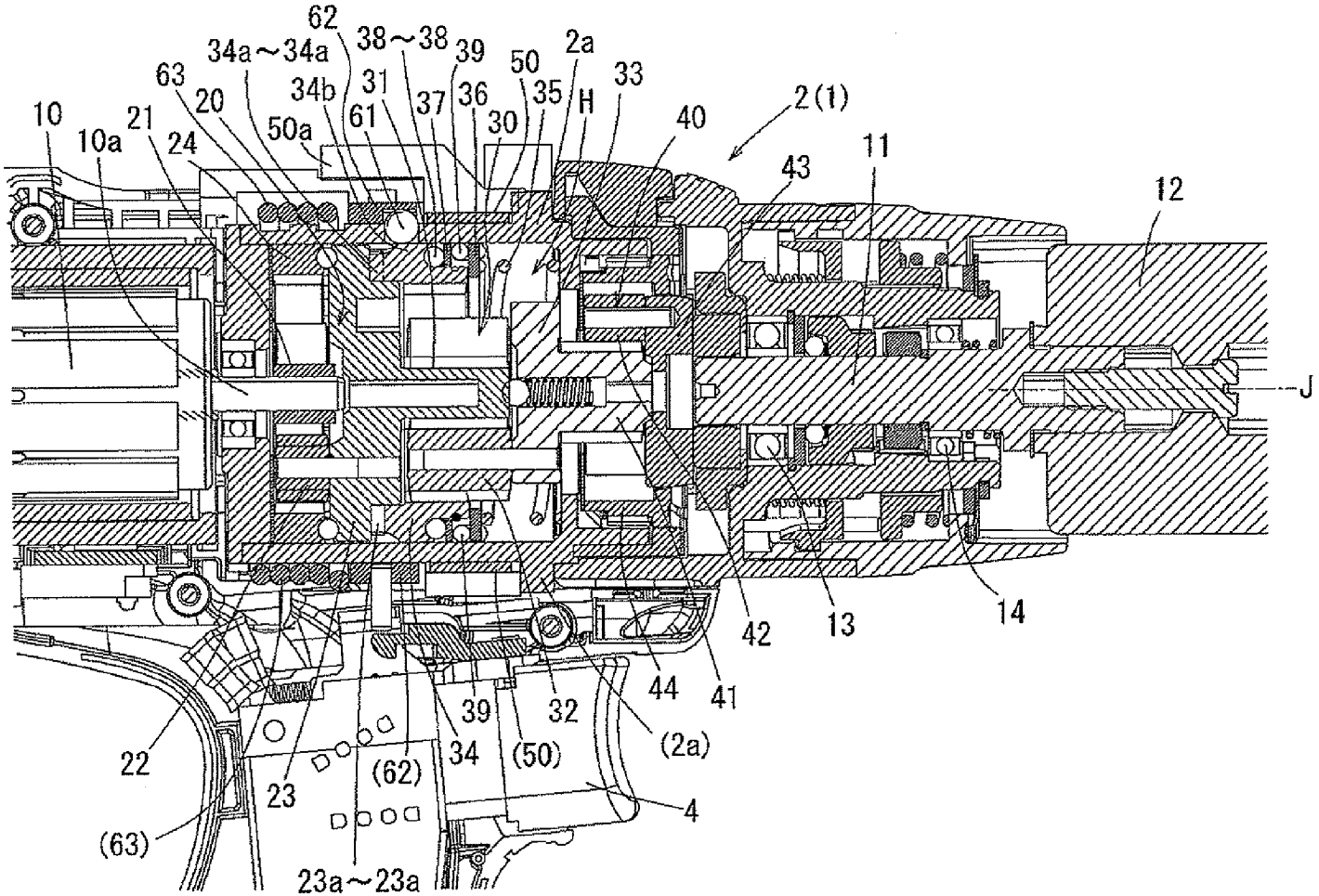
FIG. 2 is an enlarged view of the speed change device according to the embodiment. The view shows a high speed low torque output condition in an automatic speed change mode which corresponds to the initial condition of the speed change device.

The three planetary gear trains are interposed in a power transmission pathway from the electric motor 10 to the spindle 11. Hereinafter, these three planetary gear trains will be referred to as a first stage planetary gear train 20, a second stage planetary gear train 30 and a third stage planetary gear train 40 in this order from an upstream side of the power transmission pathway. Details of the first to third stage planetary gear trains 20, 30 and 40 are shown in FIG. 2. The first to third stage planetary gear trains 20, 30 and 40 are positioned coaxially with an output shaft 10*a* of the electric motor 10, and are positioned coaxially with the spindle 11. Hereinafter, a rotation axis of the spindle 11 (a rotation axis of the output shaft 10*a* of the electric motor 10) may be referred to also as an axis J. The electric motor 10, the first to third stage planetary gear trains 20, 30 and 40, and the spindle 11 are disposed on the axis J. A direction extending along the axis J corresponds to the axial direction of the electrical power tool 1, and the axial direction corresponds to a longitudinal direction of the main body portion 2.

A first stage sun gear 21 of the first stage planetary gear train 20 is attached to the output shaft 10*a* of the electric motor 10. Three first stage planetary gears 22 to 22 are meshed with the first stage sun gear 21. The three first stage planetary gears 22 to 22 are rotatably supported by a first stage carrier 23. Also, the three first stage planetary gears 22 to 22 are meshed with a first stage internal gear 24. The first stage internal gear 24 is disposed along and attached to an inner surface of the main body housing 2*a*. The first stage internal gear 24 is fixed so as to not be rotatable around the axis J and to not be movable in the direction of the axis J.

A second stage sun gear 31 is integrally provided to a center of a front surface of the first stage carrier 23. Three second stage planetary gears 32 to 32 are meshed with the second stage sun gear 31. The three second stage planetary gears 32 to 32 are rotatably supported by a second stage carrier 33. Also, the three second stage planetary gears 32 to 32 are meshed with a second stage internal gear 34. The second stage internal gear 34 is disposed along and supported on the inner surface of the main body housing 2*a* in a condition in which it is rotatable around the axis J and is displaceable within a certain range in the direction of the axis J. Details of the second stage internal gear 34 will be hereinafter described.

A third stage sun gear 41 is integrally provided to a center of a front surface of the second stage carrier 33. Three third stage planetary gears 42 to 42 are meshed with the third stage sun gear 41. The three third stage planetary gears 42 to 42 are rotatably supported by a third stage carrier 43. Also, the three third stage planetary gears 42 to 42 are meshed with a third stage internal gear 44. The third stage internal gear 44 is disposed along and attached to the inner surface of the main body housing 2*a*. The third stage internal gear 44 is fixed so as to not be rotatable around the axis J and to not be movable in the direction of the axis J.

The spindle 11 is coaxially connected to a center of a front surface of the third stage carrier 43. The spindle 11 is supported on the main body housing 2*a* via bearings 13 and 14, so as to be rotatable around the axis J. The chuck 12 is attached to the distal end of the spindle.

As previously described, the second stage internal gear 34 is supported so as to be rotatable around the axis J and movable within a certain range in the direction of the axis J. A plurality of clutch teeth 34*a* to 34*a* are circumferentially provided on a back surface of the second stage internal gear 34. The clutch teeth 34*a* to 34*a* are meshed with clutch teeth 23*a* to 23*a* that are circumferentially provided on the front surface of the first stage carrier 23 in the same way. Due to a meshing condition of the clutch teeth 23*a* and 34*a*, the second internal gear 34 can rotate together with the first stage carrier 23. The meshing condition of the clutch teeth 23*a* and 34*a* can be released when the second stage internal gear 34 is applied with an external torque for causing the second stage internal gear 34 to rotate relative to the first stage carrier 23, and the second stage internal gear 34 is displaced forwardly in the direction of the axis J (in a direction away from the first stage carrier 23).

FIG. 2 shows a condition in which the clutch teeth 34*a* to 34*a* of the second stage internal gear 34 are meshed with the clutch teeth 23*a* to 23*a* of the first stage carrier 23. In this meshing condition, the second stage internal gear 34 is positioned in a rotation allowance position that is positioned rearwardly in the direction of the axis J (a left side in FIG. 2). In the rotation allowance position, the second stage internal gear 34 rotates together with the first stage carrier 23. Therefore, in this case, the second stage sun gear 31 and the second stage internal gear 34 integrally rotate. When the external torque of a certain value or more is applied to the second stage internal gear 34 via the spindle 11, the second stage internal gear 34 rotates relative to the first stage carrier 23, so that the clutch teeth 34*a* and clutch teeth 23*a* are disengaged from each other. As a result, the second stage internal gear 34 is displaced forwardly in the direction of the axis J (toward a right side in FIG. 2).

The second stage internal gear 34 is biased toward the rotation allowance position by a compression spring 35. Thus, the second stage internal gear 34 is displaced forwardly in the direction of the axis J (in a direction in which the clutch teeth 23*a* and 34*a* are disengaged from each other) against a biasing force of the compression spring 35. Also, a certain external torque is set based on the biasing force of the compression spring 35, so that the second stage internal gear 34 can be displaced forwardly, thereby switching a reduction ratio.

The compression spring 35 acts on a front surface of the second stage internal gear 34 with interleaving a pressing plate 36 therebetween. That is, the second stage internal gear 34 is pressed toward the rotation allowance position in a direction in which the clutch teeth 34*a* and 23*a* are meshed with each other by the biasing force of the compression spring 35 acting via the annular pressing plate 36 that is contacting the front surface of the second stage internal gear 34.

A rolling plate 37 is disposed on a back side of the pressing plate 36. The rolling plate 37 also has an annular shape and is disposed along and supported on a circumferential periphery of the second stage internal gear 34 so as to be rotatable around the axis J. A large number of steel balls 38 to 38 are inserted between the rolling plate 37 and a front surface of a flange portion 34*b* that is provided on a circumferential surface of the second stage internal gear 34. The steel balls 38 to 38 and the rolling plate 37 function as a thrust bearing that is capable of applying the biasing force of the compression spring 35 to the second stage internal gear 34 while rotatably supporting the same.

Figure 3:
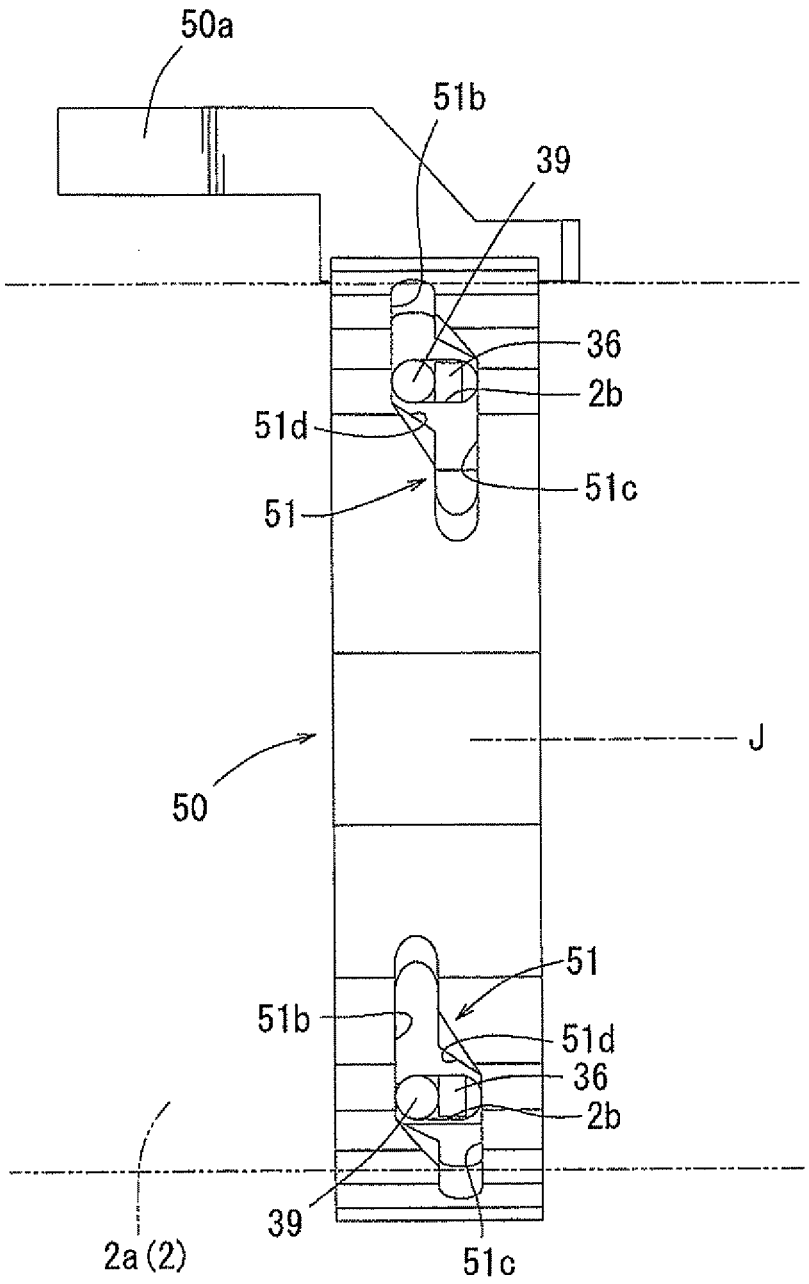
FIG. 3 is a side view of a mode switching ring in a condition in which it is switched to an automatic speed change mode position. The view shows the high speed low torque output condition.

Two upper and lower mode switching members 39 and 39 are inserted between the front side pressing plate 36 and back side rolling plate 37. Two elongated shafts (pins) are used as the two mode switching members 39 and 39. The two mode switching members 39 and 39 are positioned in an upper portion and a lower portion between the pressing plate 36 and rolling plate 37 and are inserted in a direction perpendicular to the plane of FIG. 2 in parallel to each other. Both end portions of each of the two mode switching members 39 and 39 are respectively protruded to an exterior of the main body housing 2*a*. As shown in FIG. 3, both end portions of the two mode switching members 39 and 39 are protruded to the exterior through insertion slots 2*b* to 2*b* that are formed in both side portions of the main body housing 2*a*. The two upper and lower mode switching members 39 and 39 are supported in parallel to each other while bridging both side portions of the main body housing 2*a*. Each of a total of four insertion slots 2*b* to 2*b* is formed to be elongated in the direction of the axis J and has a slot width such that each of the mode switching members 39 can be inserted therethrough. Therefore, the two upper and lower mode switching members 39 and 39 are capable of moving forward and backward in the direction of the axis J in parallel in a range in which both end portions thereof can be displaced in the insertion slots 2*b* and 2*b*. The two upper and lower mode switching members 39 and 39 simultaneously move in the same direction in parallel by a mode switching ring 50 which will be hereinafter described. In an initial condition shown in FIG. 2 (a condition in which the external torque is not applied to the spindle), the second stage internal gear 34 is positioned in the rotation allowance position by means of the compression spring 35. Therefore, in this condition, both of the mode switching members 39 and 39 are positioned rearwardly and are changed to a condition in which they are sandwiched between the pressing plate 36 and rolling plate 37.

To the contrary, when both of the mode switching members 39 and 39 move forwardly in parallel, the pressing plate 36 is moved forwardly in parallel against the compression spring 35. When the pressing plate 36 is moved forwardly in parallel, the compression spring 35 no longer acts on the second internal gear 34. In a condition in which the biasing force of the compression spring 35 does not act on the second stage internal gear 34, a force capable of maintaining the meshing condition of the clutch teeth 34*a* and clutch teeth 23*a* is lost. Therefore, when a slight external force in a rotation direction (for example, a starting torque of the electric motor 10) is applied to the second stage internal gear 34, the second stage internal gear 34 instantaneously rotates relative to the first stage carrier 23. As a result, the second stage internal gear 34 is displaced forwardly in the direction of the axis J.

The two upper and lower mode switching members 39 and 39 can be easily operated and moved from the exterior by an rotating operation of the mode switching ring 50 described above. The mode switching ring 50 has an annular shape and is supported on an outer circumferential side of the main body housing 2*a* so as to be rotatable around the axis J. The mode switching ring 50 has a finger grip portion 50*a* that is integrally provided in one place on a circumference thereof, so that the user can grip the same in order to operate and rotate the mode switching ring 50.

Three operation modes can be optionally switched by operating and rotating the mode switching ring 50 around the axis J in a certain angular range. The three operation modes correspond to an automatic speed change mode in which a rotation output of the electrical power tool 1 can be automatically switched from a "high speed low torque" output condition (a high speed low torque mode) to a "low speed high torque" output condition (a low speed high torque mode) when the external torque applied to the spindle 11 reaches the certain value that is set based on the biasing force of the compression spring 35, a high speed fixed mode in which the rotation output is fixed in the "high speed low torque" output condition, and a high torque fixed mode in which the rotation output is fixed in the "low speed high torque" output condition.

As shown in FIG. 3, the mode switching ring 50 has four switching groove portions 51 to 51 that are formed therein so as to correspond to (so as to be positioned in portion coinciding with) the four insertion slots 2*b* to 2*b* of the main body housing 2*a*. A portion of each of the end portions of the two upper and lower mode switching members 39 and 39, which portion is protruded from the main body housing 2*a*, is inserted into each switching groove portion 51.

Each switching groove portion 51 is formed in a substantially cranked shape (S-shape) and has a back side groove portion 51*b* for the high speed fixed mode which groove portion is elongated in directions around the axis J, a front side groove portion 51*c* for the high torque fixed mode which groove portion is elongated in the directions around the axis J similar to the back side groove portion 51*b*, and an intermediate groove portion 51*d* for the automatic speed change mode which groove portion communicates both of the groove portions 51*b* and 51*c* with each other. With regard to positions in the direction of the axis J, the back side groove portion 51*b* is displaced rearwardly (leftwardly in FIG. 3), and the front side groove portion 51*c* is displaced forwardly (rightwardly in FIG. 3) than that by an amount substantially equivalent to a groove width.

The intermediate groove portion 51*d* which communicates the back side groove portion 51*b* and the front side groove portion 51*c* with each other is formed so as to be elongated in the direction of the axis J and has the substantially same length as the insertion slots 2*b* of the main body housing 2. FIG. 3 shows a condition in which either end portion of each of the two upper and lower mode switching members 39 and 39 is positioned on a back side of the intermediate groove portion 51*d*. In this case, the mode switching ring 50 is switched to the automatic speed change mode. In FIG. 3, the end portion of each mode switching member 39 is positioned on the back side of the intermediate groove portion 51*d*. This condition corresponds to a condition in which the external torque of the certain value or more does not act on the spindle 11, and in which the biasing force of the compression spring 35 acts on the second stage internal gear 34 via the pressing plate 36, and as a result, the second stage internal gear 34 is held in the rotation allowance position so as to be rotated together with the first stage carrier 23. This condition corresponds to an initial condition of the speed change device H.

In the initial condition, positions of the switching groove portions 51 to 51 (positions of back end portions thereof in the direction of the axis J) are set such that the whole or a portion of the biasing force of the compression spring 35 can be received when the two upper and lower mode switching members 39 and 39 are pressed against the back end portions of the switching groove portions 51 to 51. Therefore, in an idling condition immediately after actuation of the electric motor 10 (a no load condition), the biasing force of the compression spring 35 is barely applied to the second stage internal gear 34, or only a portion thereof is applied thereto. As a result, a torque necessary to rotate the second stage internal gear 34 (a rotational resistance) is reduced, so that a power consumption (a current value) of the electrical power tool 1 can be reduced.

Figure 4:
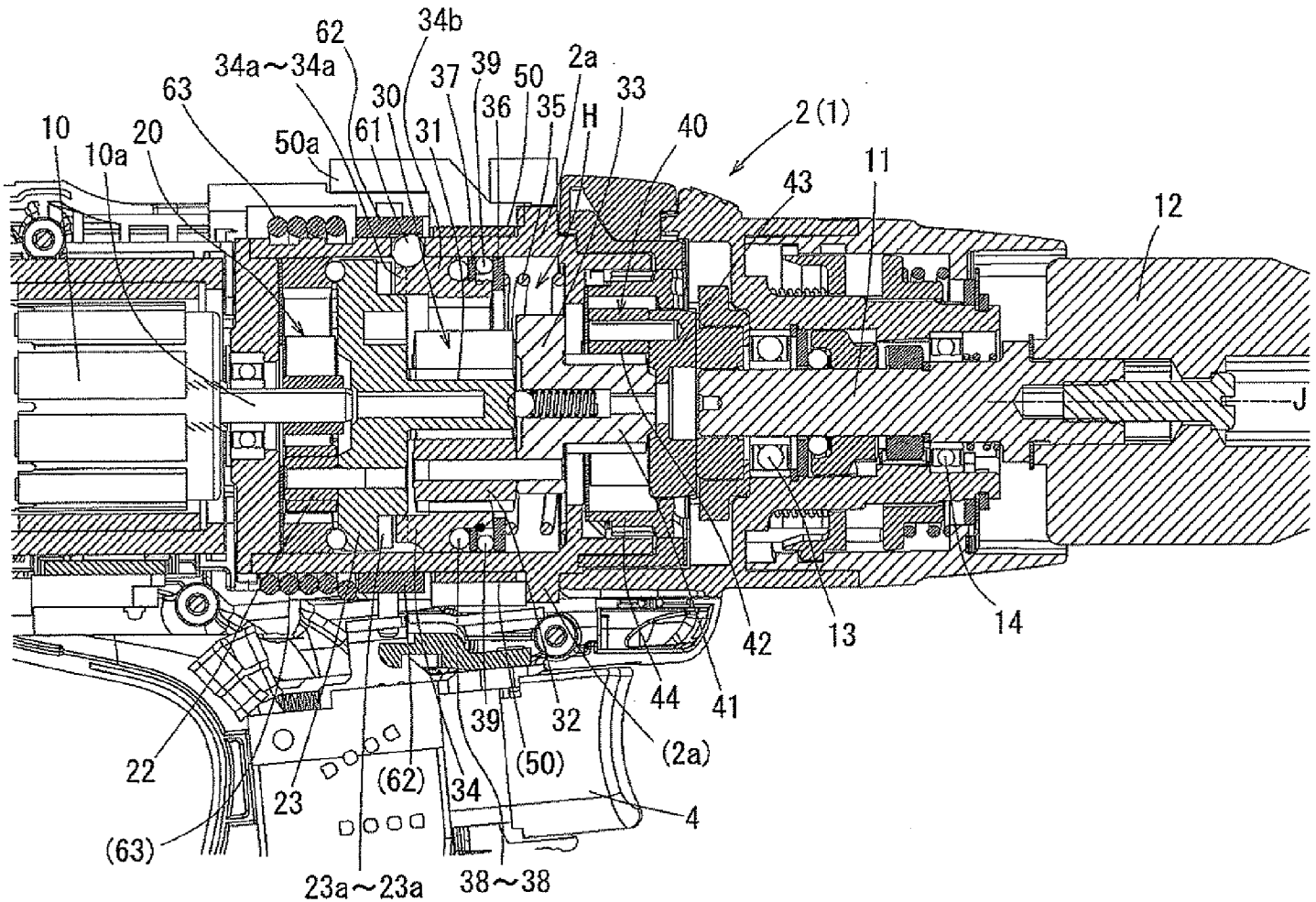
FIG. 4 is an enlarged view of the speed change device according to the embodiment. The view shows a low speed high torque output condition in the automatic speed change mode.
Figure 5:
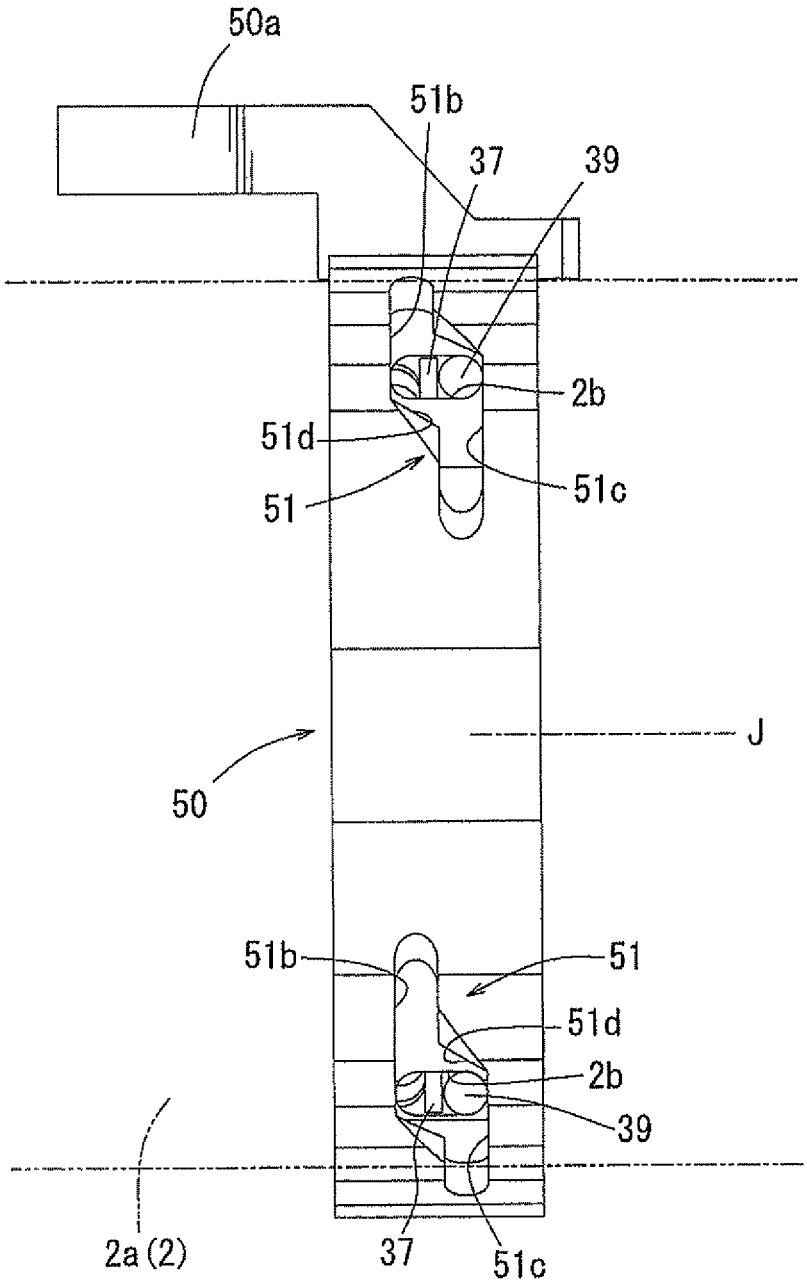
FIG. 5 is a side view of the mode switching ring in a condition which it is switched to the automatic speed change mode position. The view shows the low speed high torque output condition.

In the automatic speed change mode, each of the two upper and lower mode switching members 39 and 39 can be displaced within the intermediate groove portion 51*d* in the direction of the axis J. Therefore, when the external torque of the certain value or more is applied to the spindle 11, the second stage internal gear 34 is displaced to a rotation restriction position positioned on a front side in the direction of the axis J against the compression spring 35. This condition is shown in FIGS. 4 and 5. When the external torque applied to the spindle 11 is reduced to the certain value or less, the second stage internal gear 34 is returned to the rotation allowance position positioned on a back side in the direction of the axis J by the compression spring 35, so that the device can be returned to the initial condition in which it can rotate together with the first stage carrier 23. This condition is shown in FIGS. 2 and 3.

Because the second stage internal gear 34 is positioned in the back side rotation allowance position, in a condition in which the clutch teeth 34*a* to 34*a* of the second stage internal gear 34 are meshed with the clutch teeth 23*a* to 23*a* of the first stage carrier 23, the second stage internal gear 34 rotates together with the first stage carrier 23. As a result, the reduction ratio of the second stage planetary gear train 30 decreases, so that the spindle 11 rotates at a high speed and with a low torque.

To the contrary, when the external torque applied to the spindle 11 reaches the certain value or more, the second stage internal gear 34 is displaced to the front side rotation restriction position, so that the clutch teeth 34*a* to 34*a* of the second stage internal gear 34 and the clutch teeth 23*a* to 23*a* of the first stage carrier 23 can be disengaged from each other. In this condition, the reduction ratio of the second stage planetary gear train 30 increases, so that the spindle 11 rotates at a low speed and with a high torque. In the automatic speed change mode, the switching between a former high speed low torque output condition and a latter low speed high torque output condition can be automatically performed based on the external torque applied to the spindle 11. In the former high speed low torque output condition, as shown in FIG. 3, the mode switching members 39 and 39 are positioned on the back side of the intermediate groove portion 51*d*. In the latter low speed high torque output condition, as shown in FIG. 5, the mode switching members 39 and 39 are positioned on the front side of the intermediate groove portion 51*d*. That is, the two upper and lower mode switching members 39 and 39 are displaced in the direction of the axis J together with the second stage internal gear 34.

Figure 6:
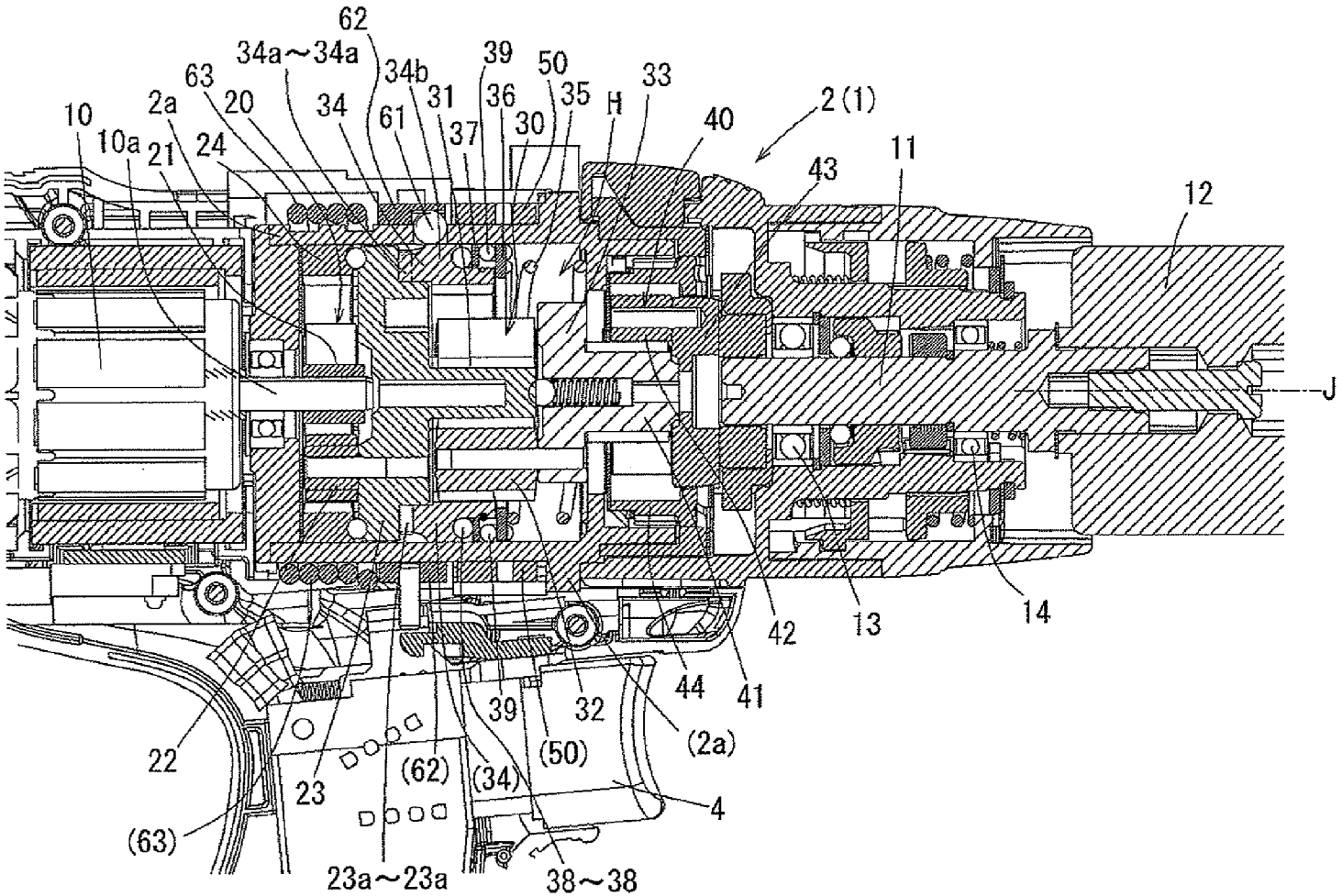
FIG. 6 is an enlarged view of the speed change device according to the embodiment. The view shows a condition in which the mode is switched to a high speed fixed mode.
Figure 7:
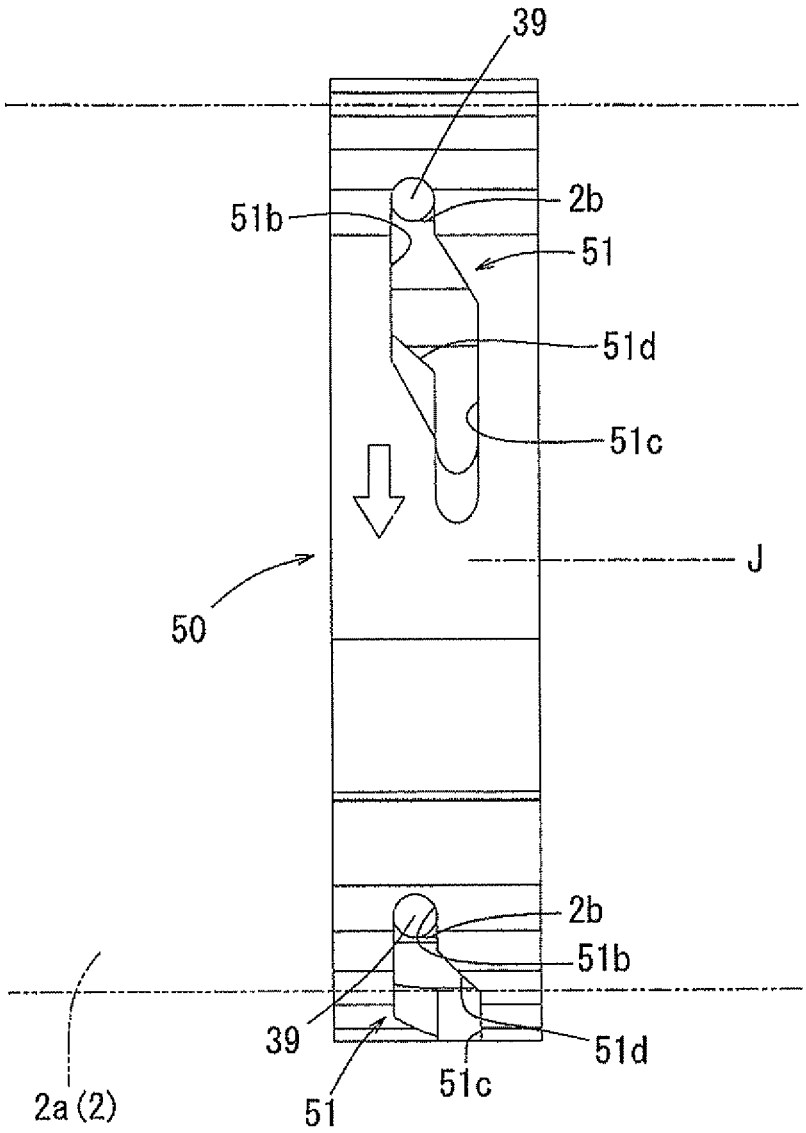
FIG. 7 is a side view of the mode switching ring in a condition in which it is switched to a high speed fixed mode position.

When the mode switching ring 50 is operated and rotated from an automatic speed change mode position shown in FIGS. 2 to 5 to a high speed fixed mode position shown in FIG. 7, the speed change device H can be switched to the high speed fixed mode. In this case, when the mode switching ring 50 is operated and rotated a certain angle clockwise as seen from the user (in a direction in which the finger grip portion 50*a* is turned over toward the near side in FIGS. 3 and 5), the automatic speed change mode is switched to the high speed fixed mode. When the mode switching ring 50 is switched to the high speed fixed mode, a condition in which either end portion of each of the two upper and lower mode switching members 39 and 39 is relatively inserted into the back side groove portion 51*b* is obtained. In this condition, both mode switching members 39 and 39 are fixed in back side positions in the direction of the axis J, so as to be prevented from being displaced forwardly. Therefore, even when the external torque of the certain value or more is applied to the spindle 11, as shown in FIG. 6, the second stage internal gear 34 is held in the rotation allowance position, so that the second stage planetary gear train 30 is held in a condition in which the reduction ratio thereof is lowered. As a result, the high speed low torque condition is output to the spindle 11. In this way, when the mode switching ring 50 is switched to the high speed fixed mode shown in FIG. 7, an output condition of the speed change device H is fixed in the high speed low torque output condition.

Also, in the high speed fixed mode, the two upper and lower mode switching members 39 and 39 contact the back end portions of the mode switching groove portions 51 similar to an initial condition in the automatic speed change mode, so that the whole or a portion of the biasing force of the compression spring 35 can be received by the mode switching members 39 and 39. Therefore, the rotational resistance of the second stage internal gear 34 can be reduced, and eventually, the power consumption (the current value) of the electrical power tool 1 can be reduced.

Figure 8:
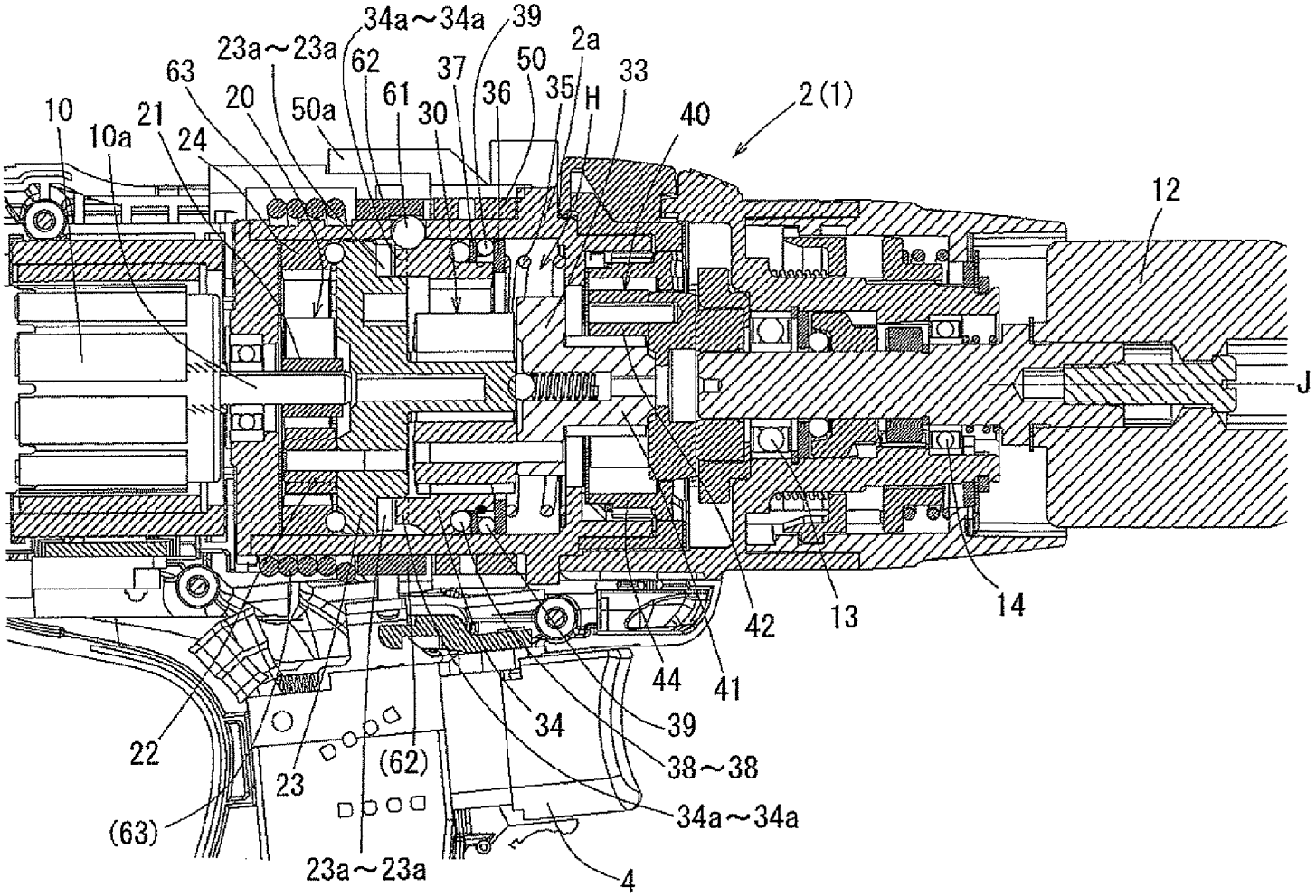
FIG. 8 is an enlarged view of the speed change device according to the embodiment. The view shows a condition in which the mode is switched to a low speed fixed mode.
Figure 9:
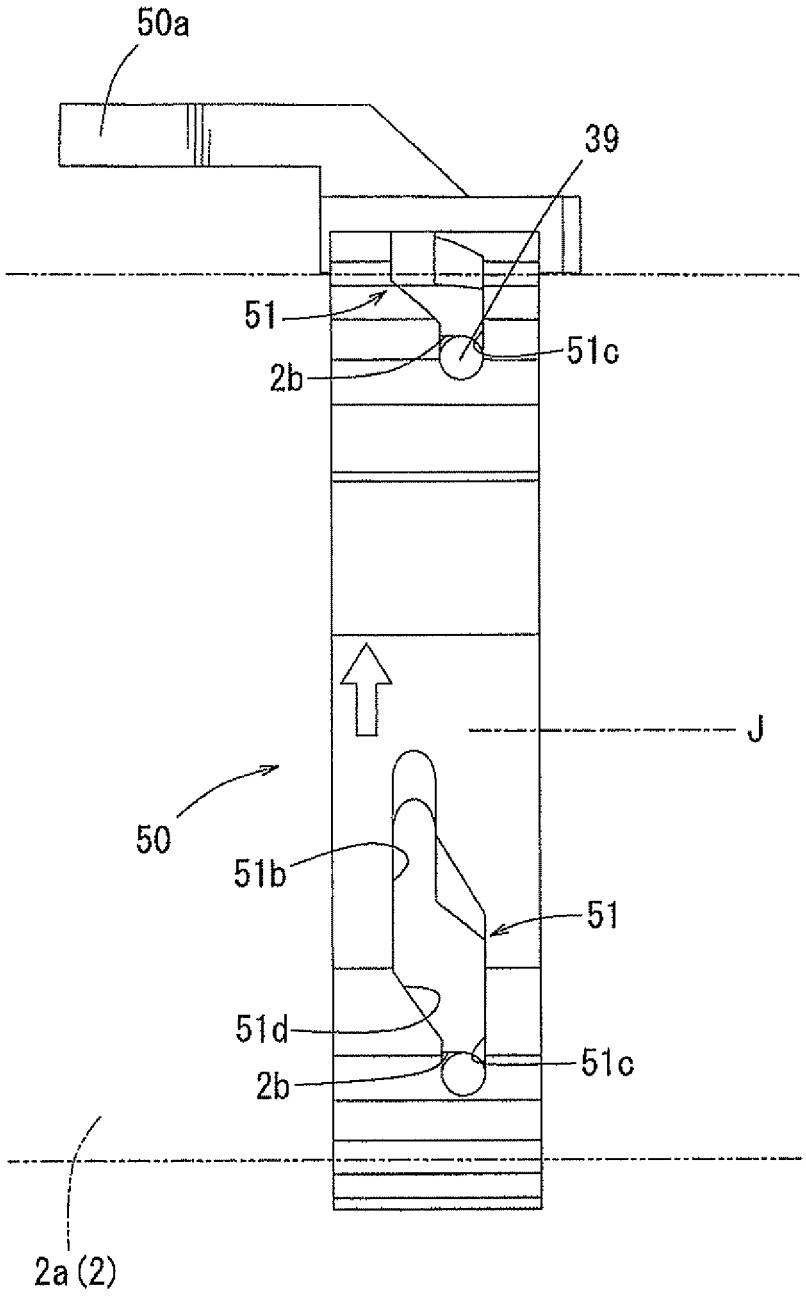
FIG. 9 is a side view of the mode switching ring in a condition in which it is switched to a low speed fixed mode position.
Figure 10:
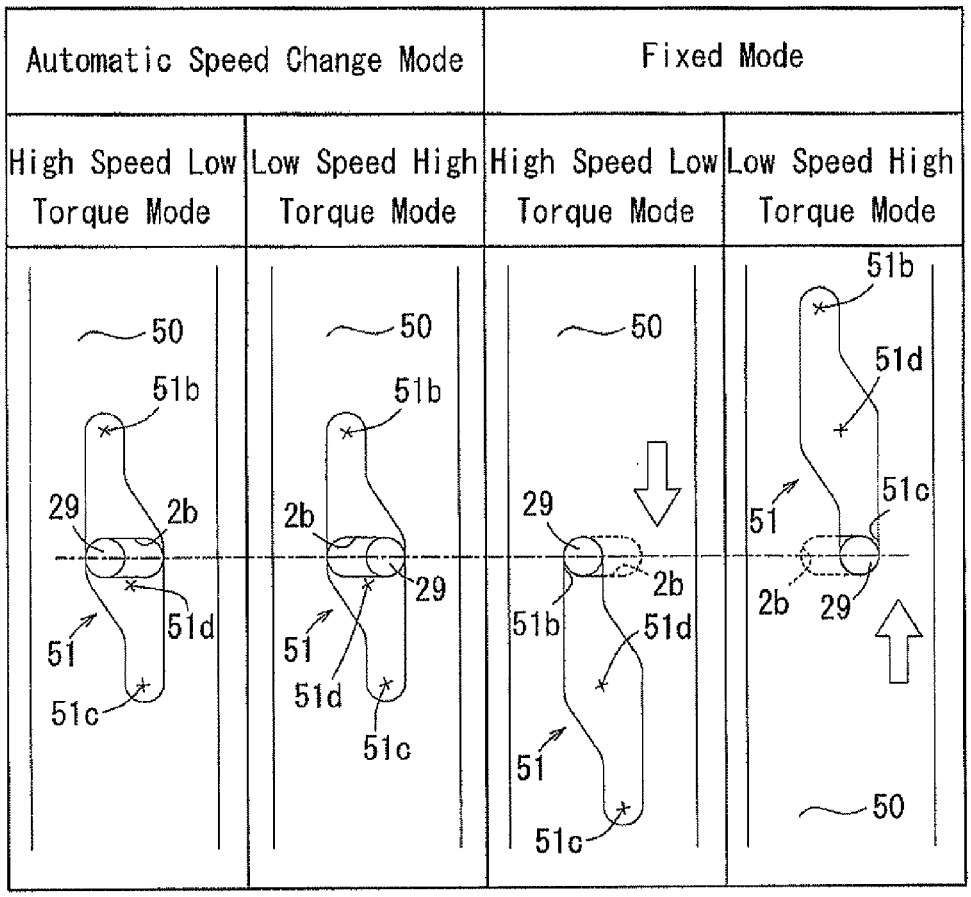
FIG. 10 is a diagram representing each operation mode of the speed change device according to the embodiment as a list.

When the mode switching ring 50 is operated and rotated from the automatic speed change mode position shown in FIGS. 3 and 5 or the high speed fixed mode position shown in FIG. 7 to a high torque fixed mode position shown in FIG. 9, the speed change device H can be switched to the high torque fixed mode. In this case, when the mode switching ring 50 is operated and rotated a certain angle counterclockwise as seen from the user (in a direction in which the finger grip portion 50*a* is turned over toward the rear side in FIGS. 3, 5 and 7), the automatic speed change mode or the high speed fixed mode is switched to the high torque fixed mode. When the mode switching ring 50 is switched to the high torque fixed mode, a condition in which either end portion of each of the two upper and lower mode switching members 39 and 39 is relatively inserted into the front side groove portion 51*c* is obtained. In the condition, both mode switching members 39 and 39 are displaced forwardly in the direction of the axis J against the compression spring 35, so as to be maintained in front side positions while being prevented from being displaced backwardly. Thus, a condition in which the biasing force of the compression spring 35 does not act on the second stage internal gear 34 is obtained. In this condition, at a point at which a slight external torque is applied to the spindle 11 (at a time at which the electric motor 10 is actuated), the second stage internal gear 34 is displaced to the front side rotation restriction position in the direction of the axis J, so as to be fixed by a mode lock mechanism 60, which will be hereinafter described, while it is prevented from being rotated. As a result, it is fixed to a condition in which a low speed high torque is output to the spindle 11. The condition is shown in FIG. 8. In this high torque condition, a condition in which the second stage internal gear 34 is substantially fixed in the front side rotation restriction position in the direction of the axis J is obtained. Therefore, it is fixed to a condition in which a low speed high torque is output.

In this way, upon operation of the mode switching ring 50 which can be operated and rotated from an exterior, the operation modes of the speed change device H can be switched to the automatic speed change mode, the high speed fixed mode, or the high torque fixed mode. A relation between each mode and the position of the mode switching member 39 within the switching groove 51 is collectively shown in FIG. 10. In the automatic speed change mode, when the external torque applied to the spindle 11 reaches the certain value, the mode is switched automatically from the high speed low torque mode having a low reduction ratio to the low speed high torque mode having a high reduction ratio. The low speed high torque mode is locked by the mode lock mechanism 60, which will be hereinafter described.

To the contrary, when the mode switching ring 50 is operated and rotated to the high speed low torque mode position, the positions of the two upper and lower mode switching members 39 and 39 in the direction of the axis J are fixed on the back side. As a result, the second stage internal gear 34 is locked in the rotation allowance position, so that a high speed low torque is constantly output to the spindle 11 regardless of a change in the external torque.

Conversely, when the mode switching ring 50 is operated and rotated to the low speed high torque mode position, the positions of the two upper and lower mode switching members 39 and 39 in the direction of the axis J are fixed on the front side. As a result, a condition in which the biasing force of the compression spring 35 does not act on the second stage internal gear 34 is obtained. Therefore, when the electric motor 10 is actuated, the second stage internal gear 34 is instantaneously displaced to the rotation restriction position by a slight external torque such as the starting torque of the electric motor 10, and is locked in the rotation restriction position by the mode lock mechanism 60, which will be hereinafter described. Thus, in the low speed high torque mode, a condition in which the second stage internal gear 34 is substantially constantly locked in the rotation restriction position is obtained, so that the low speed high torque is constantly output regardless of the change in the external torque applied to the spindle 11.

Figure 11:
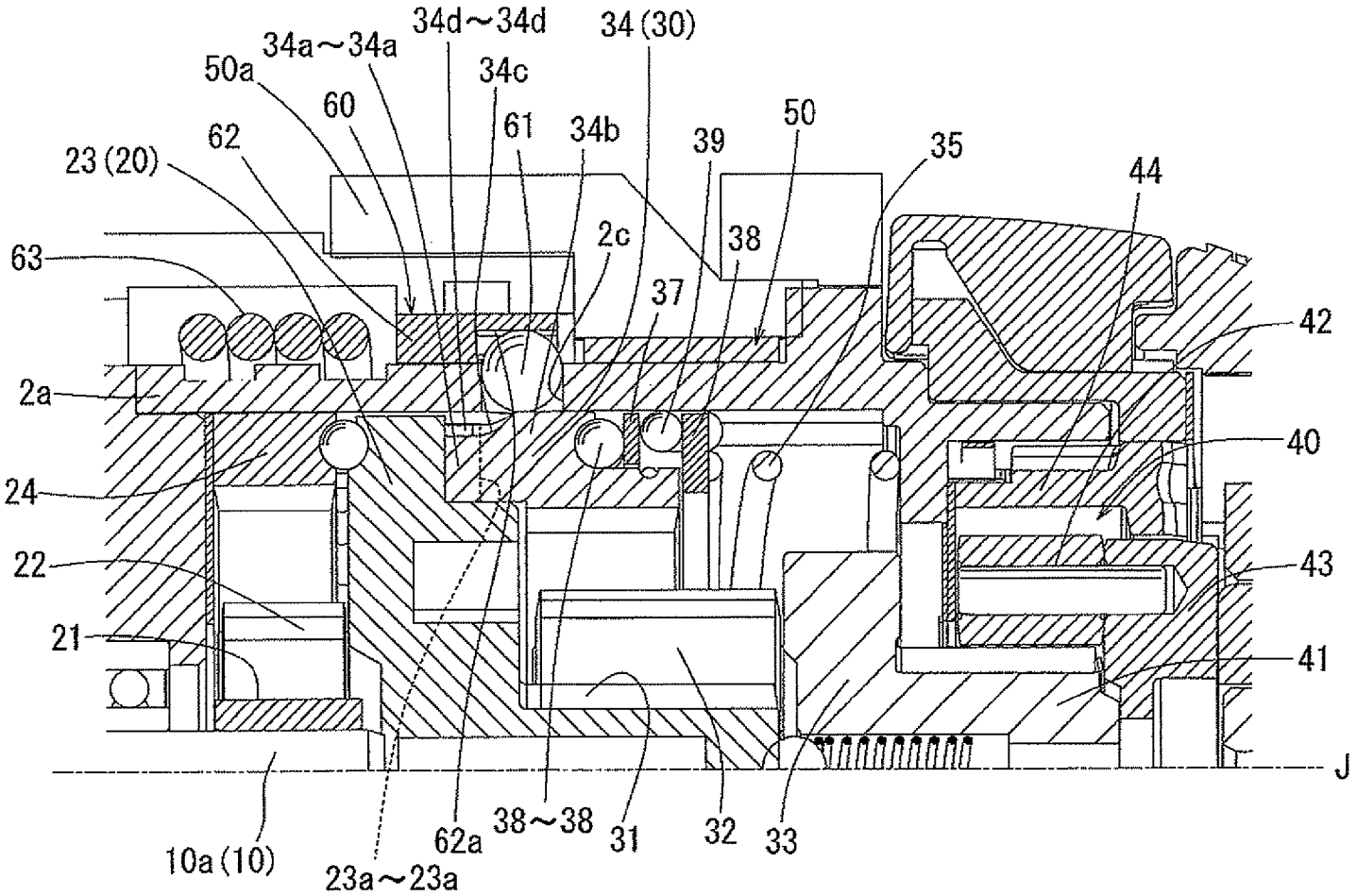
FIG. 11 is an enlarged view of a mode lock mechanism. The view shows an unlocked condition of the mode lock mechanism.
Figure 12:
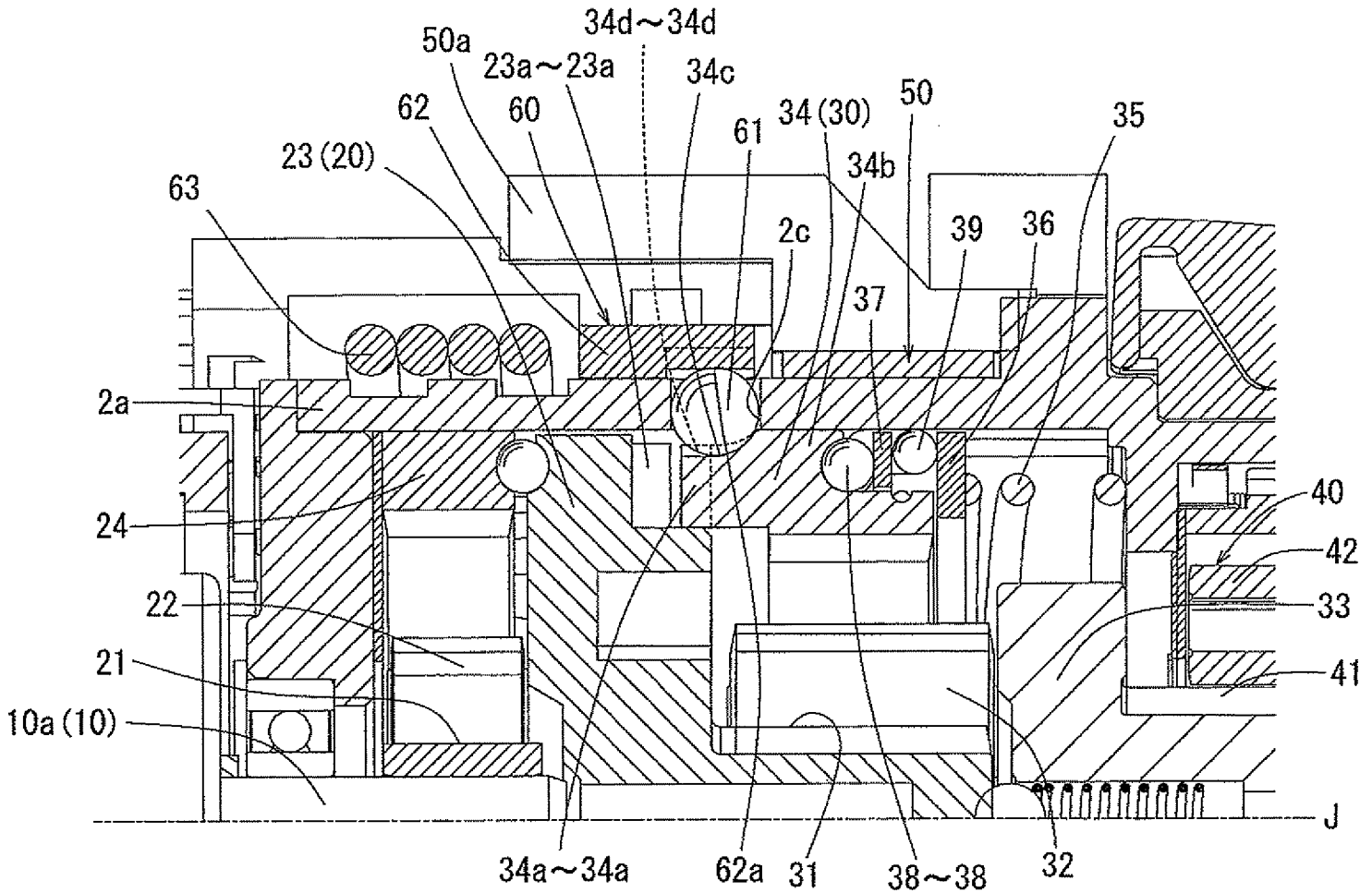
FIG. 12 is an enlarged view of the mode lock mechanism. The view shows a locked condition of the mode lock mechanism. The view shows a condition in which a second stage internal gear is locked in a rotation restriction position.

Next, the rotation restriction position (the front side position in the direction of the axis J) of the second stage internal gear 34 is held by the mode lock mechanism 60. Details of the mode lock mechanism 60 are shown in FIGS. 11 and 12. FIG. 11 shows a condition in which the mode lock mechanism 60 is released, so that the second stage internal gear 34 is held in the rotation allowance position (a condition in which the clutch teeth 23*a* and 34*a* are meshed with each other). Conversely, FIG. 12 shows a condition in which the second stage internal gear 34 is held in the rotation restriction position by the mode lock mechanism 60 (a condition in which the clutch teeth 23*a* and 34*a* are disengaged from each other).

The mode lock mechanism 60 has a function to hold the second stage internal gear 34 in the rotation restriction position positioned on the front side in the direction of the axis J, and a function to lock the second stage internal gear 34 positioned in the rotation restriction position so as to prevent the same from being rotated.

An engagement groove portion 34*c* is entirely provided in an outer circumferential surface of the second stage internal gear 34 so as to be positioned on the back side of the flange portion 34*b*. The engagement groove portion 34*c* has engagement wall portions 34*d* to 34*d* that are provided therein so as to be positioned on circumferentially trisected positions. Conversely, the main body housing 2*a* has engagement balls 61 that are held in circumferentially trisected positions thereof. The three engagement balls 61 to 61 can be referred to as an internal restriction member Further, the engagement balls 61 to 61 are held in holding holes 2*c* formed in the main body housing 2*a*. Each engagement ball 61 is held in each holding hole 2*c*, so as to be inwardly projected to and retracted from an inner circumferential side of the main body housing 2*a*. A circular ring-shaped lock ring 62 is circumferentially disposed around the three engagement balls 61 to 61. The lock ring 62 is supported along an outer circumference of the main body housing 2*a* while being capable of rotating around the axis J.

The lock ring 62 has cam surfaces 62*a* to 62*a* that are provided in circumferentially trisected positions of an inner circumferential surface thereof. The cam surfaces 62*a* to 62*a* are shaped so as to be changed circumferentially in depth, and are positioned so as to correspond to the three engagement balls 61 to 61. Each engagement ball 61 slidably contacts each cam surface 62*a*. When the lock ring 62 rotates around the axis J in a certain range due to sliding action of each engagement ball 61 against each cam surface 62*a*, in the holding hole 2*c*, each engagement ball 61 moves between a retracted position (a position shown in FIG. 11) in which it is not inwardly projected to the inner circumferential side of the main body housing 2*a* and an engagement position (a position shown in FIG. 12) in which it is inwardly projected to the inner circumferential side of the main body housing 2*a*.

The lock ring 62 is biased in one of the directions around the axis J (to a locking side) by a torsion coil spring 63 that is interposed between the lock ring 62 and the main body housing 2*a*. With regard to a biasing direction of the lock ring 62 by the torsion coil spring 63, the lock ring 62 is biased to the direction (to the locking side) such that the cam surface 62*a* is rotated to displace each engagement ball 61 toward the engagement position. As shown in FIG. 11, in the condition in which the second stage internal gear 34 is positioned in the rotation allowance position by the biasing force of the compression spring 35, the flange portion 34*b* of the second stage internal gear 34 is positioned so as to close the holding holes 2*c*. As a result, each of the engagement balls 61 to 61 is pushed to the retracted position. Therefore, the lock ring 62 is in a condition in which it is returned to an unlocking side against the torsion coil spring 63.

To the contrary, as shown in FIG. 12, when the second stage internal gear 34 moves to the rotation restriction position against the compression spring 35 or as a result of the biasing force of the compression spring 35 not acting, a condition in which the flange portion 34*b* is withdrawn from each holding hole 2*c* and in which the engagement groove portion 34*c* is aligned with each holding hole 2*c* is obtained. Thus, each engagement ball 61 is inwardly displaced to the inner circumferential side of the main body housing 2*a* and is fitted in the engagement groove portion 34*c*. Further, this fitted condition is maintained by a biasing force of the torsion coil spring 63. Thus, because each engagement ball 61 is held in the condition in which it is fitted in the engagement groove portion 34*c*, the second stage internal gear 34 is held in the rotation restriction position and each engagement ball 61 engages the engagement wall portion 34*d*. As a result, a condition in which the rotation around the axis J of the second stage internal gear 34 is locked is obtained. Further, when the second stage internal gear 34 is locked in the rotation restriction position, the condition in which the clutch teeth 34*a* to 34*a* thereof are disengaged from the clutch teeth 23*a* to 23*a* of the first stage carrier 23 is maintained.

Also, each of the engagement balls 61 to 61 is indirectly biased toward the engagement position because the biasing force of the torsion coil spring 63 acts thereon via the cam surface 62*a*. When each engagement ball 61 is fitted into the engagement groove portion 34*c* by a biasing force which biases each engagement ball 61 toward the engagement position, the biasing force can act through an interaction between a spherical shape of the engagement ball 61 and an inclined surface of the engagement groove portion 34*c*. Therefore, the biasing force can further indirectly act on the second stage internal gear 34 as a biasing force that biases the same toward the rotation restriction position. When the indirect biasing force of the torsion coil spring 63 acts on the second stage internal gear 34 as the biasing force that biases the same toward the rotation restriction position, the second stage internal gear 34 starts to be displaced from the rotation allowance position toward the rotation restriction position by the external torque that is returned via the spindle 11. As a result, each engagement ball 61 is instantaneously fitted into the engagement groove portion 34*c*, so that the second stage internal gear 34 quickly moves widely toward the rotation restriction position. Thus, as shown in FIG. 12, in a condition in which the second stage internal gear 34 is moved to the rotation restriction position, a condition in which an appropriate clearance is produced between the clutch teeth 34*a* to 34*a* of the second stage internal gear 34 and the clutch teeth 23*a* to 23*a* of the first stage carrier 23 is obtained. Therefore, the clutch teeth 23*a* to 23*a* of the first stage carrier 23 rotating in the directions around the axis J can be avoided from contacting each clutch teeth 34*a* of the second stage internal gear 34 that is rotationally locked. This allows a silent operation even after a speed changing operation to the high torque condition.

As a locking position of the lock ring 62 is maintained by the torsion coil spring 63, the speed change device 10 is held on the low speed high torque side. The locking position of the lock ring 62 can be released by a manual operation of the user. When the user manually operates the lock ring 62 held in the locking position to rotate the same to an unlocking position against the torsion coil spring 63, each engagement ball 61 is placed in a condition in which it is retracted to the retracted position. As a result, the second stage internal gear 34 is returned to the rotation allowance position by the compression spring 35. When the second stage internal gear 34 is returned to the rotation allowance position, a condition in which the clutch teeth 34*a* to 34*a* thereof are meshed with the clutch teeth 23*a* to 23*a* of the first stage carrier 23 is obtained. Also, when the second stage internal gear 34 is returned to the rotation allowance position, because the holding holes 2*c* are closed by the flange portion 34*b* of the second stage internal gear 34, each engagement ball 61 is held in the retracted position. Thus, even if the user takes his/her fingertip off the lock ring 61 thereafter, the lock ring 62 is held in the unlocking position against the torsion coil spring 63. Further, such a structure in which the lock ring 62 is returned to the unlocking position (an initial position) by the manual operation can be changed to, for example, a structure in which the lock ring 62 is automatically returned to the unlocking position by operating the trigger-type switch lever 4 as previously described.

Next, the electrical power tool 1 is designed such that the electrical power tool 1 of which the handle portion 3 is gripped by the user is prevented from being swung around the axis J by an inertia moment I that can be produced when the high speed low torque mode is switched to the low speed high torque mode in the condition in which the speed change device H is switched to the automatic speed change mode. As shown in FIG. 1, in the present embodiment, an 18V power type of battery pack 5 (mass M=0.6 kg) is used, and a distance L between a center of gravity G of the battery pack 5 and the axis J is set to 195 mm. Therefore, the inertia moment I ($kg \cdot mm^2$) required to rotate the electrical power tool 1 rotate around the axis J is calculated as follows:

$$L^2 \times M = (195\ \text{mm})^2 \times 0.6\ \text{kg} = \text{approximately } 23{,}000\ (\text{kg} \cdot \text{mm}^2)$$

In this regard, in a conventional electrical power tool having an automatic speed change device, because the distance between the center of gravity of the battery pack and the axis is comparatively short, the inertia moment I required to swing the electrical power tool 1 around the axis J is set to be small. As a result, when the operation modes are switched from the high speed low torque mode to the low speed high torque mode by an automatic speed change, the electrical power tool is likely to be swung around the axis J by the inertia moment generated thereby. Therefore, the user must hold the handle portion strongly such that the electrical power tool 1 cannot to be swung. This mans that the conventional electrical power tool is low in terms of usability.

According to the electrical power tool 1 of the present embodiment, because the distance between the center of gravity G of the battery pack 5 and the axis J (a rotation center of the spindle 11) is set to be longer than the conventional electrical power tool, i.e., the inertia moment I around the axis J is set to be larger than the conventional electrical power tool, the electrical power tool 1 is no longer likely to be swung by the reaction around the axis J that can be generated by the automatic speed change. Therefore, the user can hold the handle portion 3 with a force smaller than a conventionally required force. That is, a position of the electrical power tool 1 can be easily maintained (can be stationary maintained without being swung around the axis J). This mans that the electrical power tool 1 is superior to the conventional electrical power tool in terms of usability.

An effect to prevent a swing of the electrical power tool 1 cause by torque fluctuations can be enhanced as the distance L between the axis J and the center of gravity G of the battery pack 5 is increased. Similarly, it can be enhanced as the mass M of the battery pack 5 is increased.

According to the electrical power tool 1 of the present embodiment thus constructed, the second stage internal gear 34 in the second stage planetary gear train 20 that is contained in the first to third stage planetary gear trains 20, 30 and 40 constituting the speed change device H can move between the rotation allowance position and the rotation restriction position in the direction of the axis J, so that the reduction ratio can be switched in two stages, i.e., switched between the high speed low torque output condition (the high speed low torque mode) and the low speed high torque output condition (the low speed high torque mode). Because the mode switching members 39 and 39 can be displaced in the direction of the axis J in a condition in which the mode switching ring 50 is switched to the automatic speed change mode position, this two output conditions can be automatically switched based on the external torque exerted on the spindle 11. Therefore, the user can quickly progress the screw tightening operation at the high speed low torque in an initial stage of, for example, the screw tightening operation, and can reliably complete the screw tightening operation at the low speed high torque without producing a so-called come-out or the incomplete tightening on or after the external torque applied to the spindle 11 (a screw tightening resistance) reaches a certain value in a latter stage of the screw tightening operation, without performing a specific switching operation.

Also, in the present embodiment, when the speed change device H is switched to the low speed high torque output condition, the output condition thereof (the rotation restriction position of the second stage internal gear 34) is automatically locked by the mode lock mechanism 60. Therefore, unlike the conventional device, an operating condition thereof can be prevented from being fluctuated between both output conditions. As a result, a qualitatively stable operation can be efficiently performed.

Further, when the mode switching ring 50 is switched to the high speed fixed mode position, the switching members 39 and 39 are fixed in the back side positions in the direction of the axis J. As a result, the second stage internal gear 34 is fixed to the rotation allowance position. Therefore, the speed change device H can be used in the high speed low torque output condition regardless of the external torque. To the contrary, when the mode switching ring 50 is switched to the low speed fixed mode position, the switching members 39 and 39 are fixed in the front side positions in the direction of the axis J. As a result, the second stage internal gear 34 is substantially fixed to the rotation restriction position. Therefore, the speed change device H can be used in the low speed high torque output condition regardless of the external torque. Even in the low speed high torque output condition, the second stage internal gear 34 can be reliably retained in the rotation restriction position by the mode lock mechanism 60.

Further, according to the mode lock mechanism 60 of the present embodiment, because the engagement balls 61 to 61 are fitted into the engagement groove portion 34*c* formed in the second stage internal gear 34 by the indirect biasing force of the torsion coil spring 63, the second stage internal gear 34 moves from the rotation allowance position forwardly in the direction of the axis 3 over a desired distance, the condition in which a sufficient clearance is produced between the clutch teeth 34*a* to 34*a* of the second stage internal gear 34 and the clutch teeth 23*a* to 23*a* of the first stage carrier 23 is obtained. Therefore, the clutch teeth 34*a* to 34*a* of the second stage internal gear 34 that are rotationally locked can be avoided from contacting the clutch teeth 23*a* to 23*a* of the rotating first stage carrier 23. This allows the silent operation of the electrical power tool 1 in the low speed high torque output condition.

Further, mainly in the automatic speed change mode and the high speed fixed mode, the whole or a portion of the biasing force of the compression spring 35 can be received by the two mode switching members 39 and 39. Therefore, in the no load condition (the idling condition) such as the initial condition, the torque necessary to rotate the second stage internal gear 34 can be reduced. As a result, the power consumption (the current value) of the electrical power tool 1 can be reduced.

Figure 13:
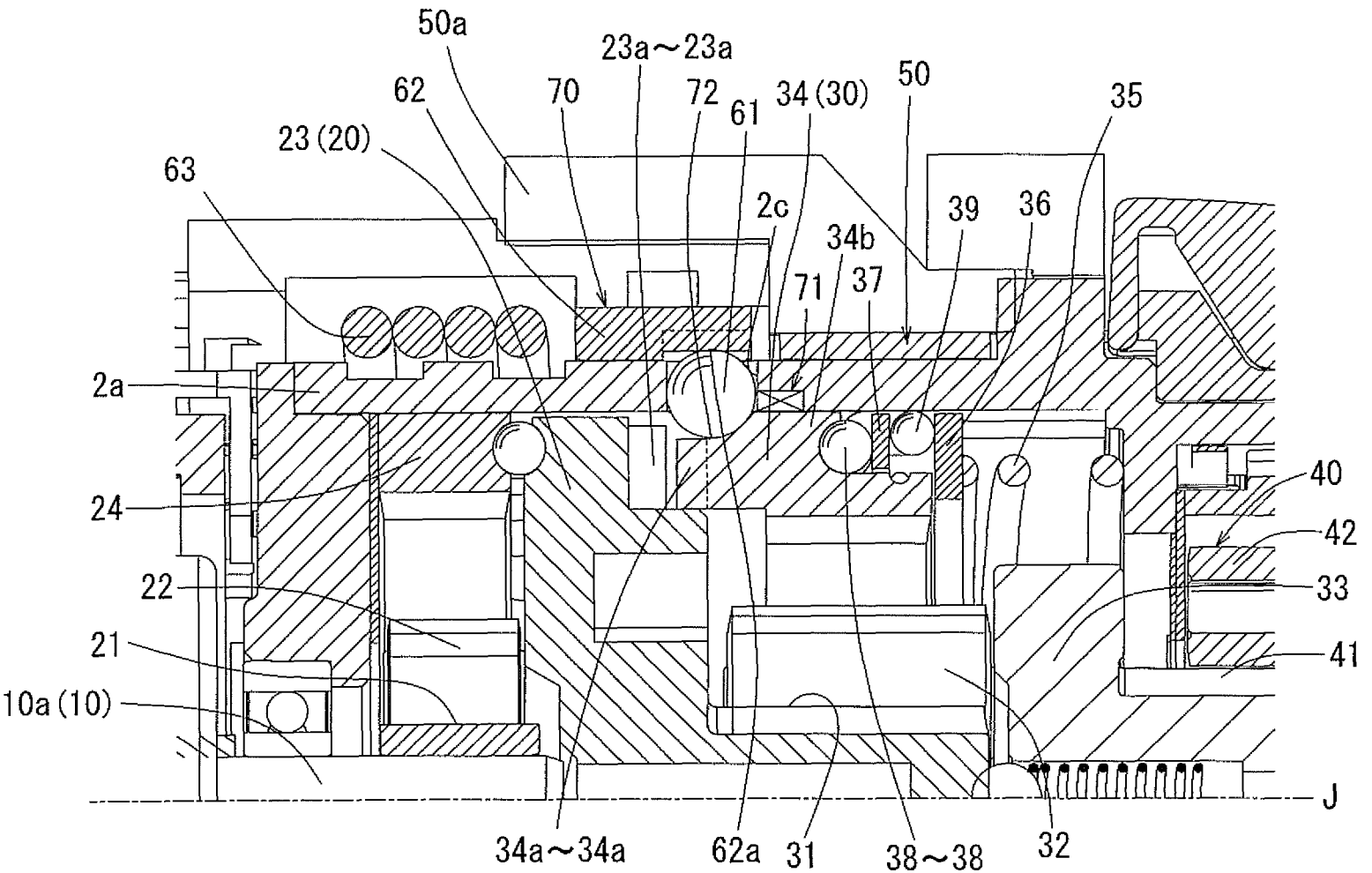
FIG. 13 is an enlarged view of a mode lock mechanism according to a second embodiment of the present invention. The view shows a condition in which a second stage internal gear is rotationally locked by a one-way clutch in a rotation restriction position.
Figure 14:
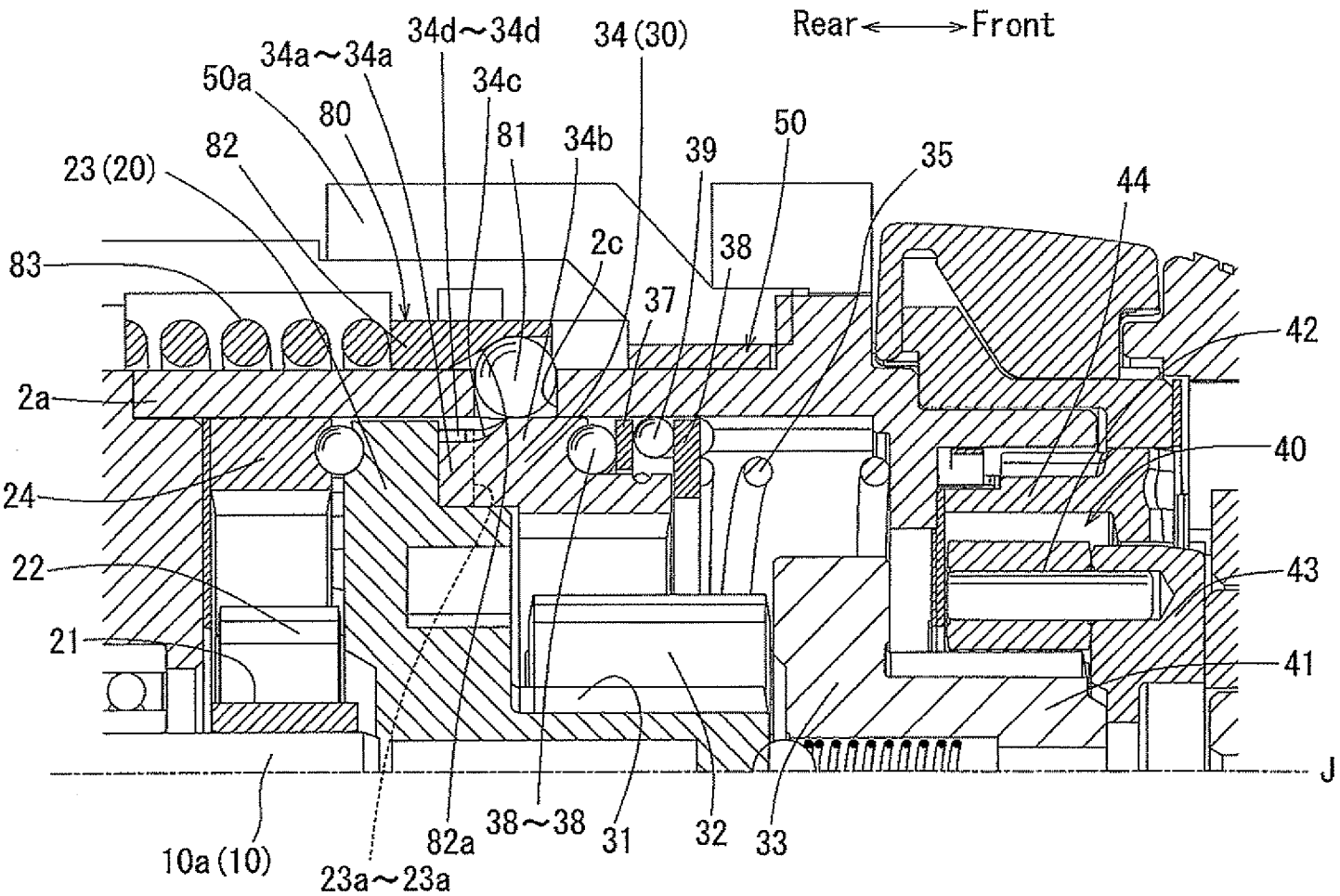
FIG. 14 is an enlarged view of a mode lock mechanism according to a third embodiment of the present invention. The view shows an unlocked condition of the mode lock mechanism.

Various modifications may be made to the embodiment described above. For example, in the exemplified mode lock mechanism 60 (the first embodiment), in the low speed high torque output condition in which the second stage internal gear 34 is shifted to the rotation restriction position, each of the engagement balls 61 to 61 is fitted into the engagement groove portion 34*c* formed in the second stage internal gear 34 and engages each engagement wall portion 34*d*, so that the second stage internal gear 34 can be prevented from being rotated. However, a different mechanism can be used in order to prevent the second stage internal gear 34 from being rotated. FIG. 13 shows a mode lock mechanism 70 according to a second embodiment. In the first embodiment, the engagement balls 61 to 61 are fitted into the engagement groove portion 34*c*, so that the second stage internal gear 34 can be prevented from being axially displaced. In addition, each engagement ball 61 engages each engagement wall portion 34*d*, so that the second stage internal gear 34 can be prevented from being rotated. However, the second embodiment is different from the first embodiment in that the second stage internal gear 34 can be prevented from being rotated via a one-way clutch 71 that is separately provided.

In the mode lock mechanism 70 according to the second embodiment, the one-way clutch 71 is used as a means that is capable of restricting the second stage internal gear 34 positioned in the rotation restriction position from being rotated. Further, in the mode lock mechanism 70 according to the second embodiment, a similar engagement groove portion 72 is entirely provided in the outer circumferential surface of the second stage internal gear 34. However, the engagement groove portion 72 does not have a portion corresponding to each engagement wall portion 34*d* in the first embodiment. Because other constructions of the second embodiment are the same as the first embodiment, elements that are the same in these embodiments will be identified by the same reference numerals and a detailed description of such elements may be omitted.

In the second embodiment, because the one-way clutch 71 has known constructions, a detailed description thereof may be omitted. The one-way clutch 71 is disposed between the second stage internal gear 34 and the main body housing 2*a*. A rotation direction that can be restricted (locked) by the one-way clutch 71 is a direction opposite to a rotation direction of the second stage internal gear 34 in the rotation allowance position. Upon increase of the torque, the second stage internal gear 34 axially moves, so that the clutch teeth 23*a* to 23*a* of the first stage carrier 23 and the clutch teeth 34*a* to 34*a* of the second stage internal gear 34 are disengaged from each other. As a result, due to characteristics of the planetary gear trains, the rotation direction of the second stage internal gear 34 can be reversed. Reverse rotation thus produced can be locked by the one-way clutch 71. Thus, when the second stage internal gear 34 moves from the rotation allowance position to the rotation restriction position, the second stage internal gear 34 cannot rotate in either direction. That is, the second stage internal gear 34 can be positioned in a condition in which it is unrotatably secured to the main body housing 2*a*.

Further, when the second stage internal gear 34 moves to the rotation restriction position, the three engagement balls 61 to 61 enter the engagement groove portion 72 that is entirely formed in the outer circumferential surface of the second stage internal gear 34, so that the second stage internal gear 34 can be restricted from being shifted to the rotation allowance position (from being moved in the direction of the axis J).

In the mode lock mechanism 70 according to the second embodiment thus constructed, in a condition in which the second stage internal gear 34 is positioned in the rotation allowance position, the second stage internal gear 34 can rotate integral with the first stage carrier 23, so that the high speed low torque can be output. When the external torque of a certain value or more is applied to the spindle 11 with progression of the operation in the high speed low torque mode, the second stage internal gear 34 moves to the rotation restriction position against the compression spring 35. At this time, the second stage internal gear 34 is rotationally locked by the one-way clutch 71. At the same time, the engagement balls 61 to 61 enter the engagement groove portion 72, so that the second stage internal gear 34 can be restricted from moving in the direction of the axis J. As a result, the speed change device H is locked in the low speed high torque mode. Thus, the switched mode of the speed change device H can be reliably maintained by the mode lock mechanism 70. Therefore, similar to the first embodiment, it is possible to increase efficiency of the operation than ever before. Also, a qualitatively stable operation can be performed even if the user is changed.

Various modifications may be further made to the first and second embodiments described above. For example, the third stage planetary gear train 40 can be omitted.

Also, the second stage planetary gear train 20 can be omitted. That is, the speed change device can be practiced using a single planetary gear train. In this case, a flanged portion is formed in the second stage sun gear 31 attached to the output shaft 10*a* of the electric motor 10. Further, clutch teeth corresponding to the clutch teeth 23*a* to 23*a* are formed in a front surface of the flanged portion. The clutch teeth are constructed to mesh with the clutch teeth 34*a* to 34*a* of the second stage internal gear 34.

Further, in the embodiments, the upper and lower two shafts (pins) are exemplified as the mode switching members 39 and 39. These shafts are displaced in the direction of the axis J by an external operation, so as to switch between the condition in which the biasing force of the compression spring 35 acts on the second stage internal gear 34 and the condition in which the biasing force of the compression spring 35 does not act thereon. However, this function can be performed by different forms. Also, in the embodiments, a construction in which the mode switching members are displaced in the direction of the axis J by rotating the mode switching ring 50 is exemplified. However, the mode switching ring 50 can be omitted. In this case, the user may directly move the mode switching members in the direction of the axis J and retain the position thereof.

Further, in the embodiments, the engagement balls 61 to 61 that are held in the circumferentially trisected positions of the main body housing are exemplified as the internal restriction member. However, instead of these, it is possible to use engagement shafts, engagement projections or other such members. Further, the exemplified mode lock mechanism 60 is constructed of the lock ring 62 having the cam surfaces 62*a* that are shaped to be changed circumferentially in depth, and the torsion coil spring 63 that is capable of biasing the lock ring 62 around the axis J. However, this function can be performed by different forms. For example, the main body housing 2*a* can be circumferentially provided with an appropriate number of detent mechanisms as the internal restriction member, so that the second stage internal gear 34 can be unrotatably secured in the rotation restriction position.

Further, the screwdriver drill is exemplified as the electrical power tool 1. However, the electrical power tool 1 may be a single function machine such as an electric screwdriver for hole drilling and an electric screw tightening machine. Further, the electrical power tool is not limited to the exemplified machine that is powered by a rechargeable battery. However, the electrical power tool may be a machine that is powered by an alternating-current source.

FIGS. 14 to 18 show a mode lock mechanism 80 according to a third embodiment that is capable of locking the second stage internal gear 34 in the rotation restriction position so as to lock the speed change device H in the low speed high torque mode. The mode lock mechanism 80 according to the third embodiment includes a reset mechanism 90 that is capable of returning a lock ring 82 to the unlocking side (the initial position). Constructions and elements that are the same as the mode lock mechanism 60 or 70 according to the first or second embodiment will be identified by the same reference numerals and a detailed description of such constructions and elements may be omitted.

The lock ring 62 of the mode lock mechanism 60 according to the first embodiment is supported to be rotatable around the axis J. Also, the lock ring 62 has the cam surfaces 62*a* to 62*a* that are provided in the circumferentially trisected positions of the inner circumferential surface thereof and are changed circumferentially in depth. The lock ring 62 is biased to the locking side in rotational directions around the axis J by the torsion coil spring 63. In this regard, the lock ring 82 of the mode lock mechanism 80 according to the third embodiment is supported so as to be movable over a desired range in the direction of the axis J. Further, the lock ring 82 has a cam surface 82*a* that is entirely provided in an inner circumferential surface thereof and is changed in the direction of the axis J in depth. As shown in the drawings, the cam surface 82*a* has a maximum depth at a front end side (a right end side in FIG. 14) of the lock ring 82 and is inclined so as to be gradually reduced in depth toward a rear portion of the lock ring 82.

Three engagement balls 81 to 81 (the internal restriction member) slidably contact the cam surface 82*a*. Similar to each of the embodiments described above, the three engagement balls 81 to 81 are held in the holding holes 2*c* to 2*c* that are provided in circumferentially trisected positions of the inner circumferential surface of the main body housing 2*a*. As shown in the drawings, in a condition in which the lock ring 82 is positioned in the front side locking position, each engagement ball 81 slidably contacts the cam surface 82*a* at a deepest portion thereof. Therefore, each engagement ball 81 is positioned in a condition in which it is not projected to the inner circumferential side of the main body housing 2*a*. As previously described, in this condition, the second stage internal gear 34 is held in the rotation allowance position, so that the mode is switched to the high speed low torque mode.

A compression spring 83 is interposed between a rear surface of the lock ring 82 and the main body housing 2*a*. The lock ring 82 is biased toward the front side locking position by the compression spring 83. Therefore, in the condition in which the second stage internal gear 34 is positioned in the rotation allowance position by the biasing force of the compression spring 35, the flange portion 34*b* of the second stage internal gear 34 is positioned so as to close the holding holes 2*c*. As a result, each of the engagement balls 81 to 81 is held in the retracted position (the position in which it is not projected into the main body housing 2*a*). Therefore, the lock ring 82 can be held in the rear side unlocking position (the initial position) against the compression spring 83.

When the second stage internal gear 34 moves to the rotation restriction position against the compression spring 35 or as a result of the biasing force of the compression spring 35 not acting, a condition in which the flange portion 34*b* is withdrawn from each holding hole 2*c* and in which the engagement groove portion 34*c* is aligned with each holding hole 2*c* is obtained. Thus, each engagement ball 81 is inwardly displaced to the inner circumferential side of the main body housing 2*a* and is fitted in the engagement groove portion 34*c*, so that the low speed high torque mode can be locked. Further, this locked condition is maintained by a biasing force of the compression spring 83.

The locked condition of the mode lock mechanism 80 can be automatically released by the reset mechanism 90, so that the mechanism can be returned to the initial condition. Details of the reset mechanism 90 is shown FIG. 15 and the subsequent figures. The reset mechanism 90 includes a reset arm 91 and a reset motor 92 for moving the reset arm 91. In this embodiment, a small electric motor is used as the reset motor 92. The reset motor 92 can be referred to as an actuate.

Figure 17:
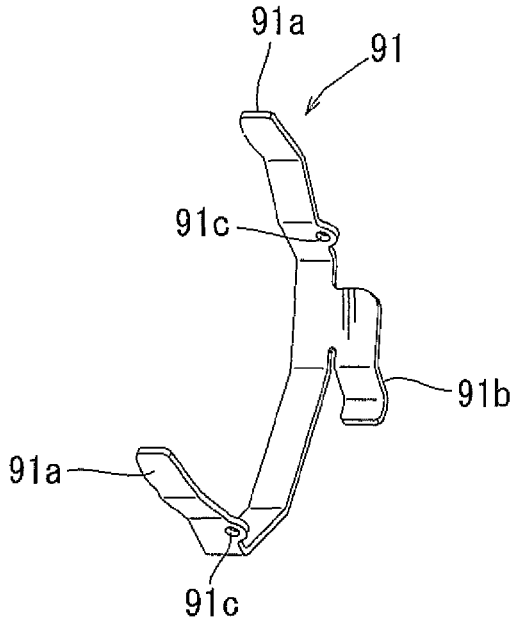
FIG. 17 is a perspective view of a reset arm only.
Figure 18:
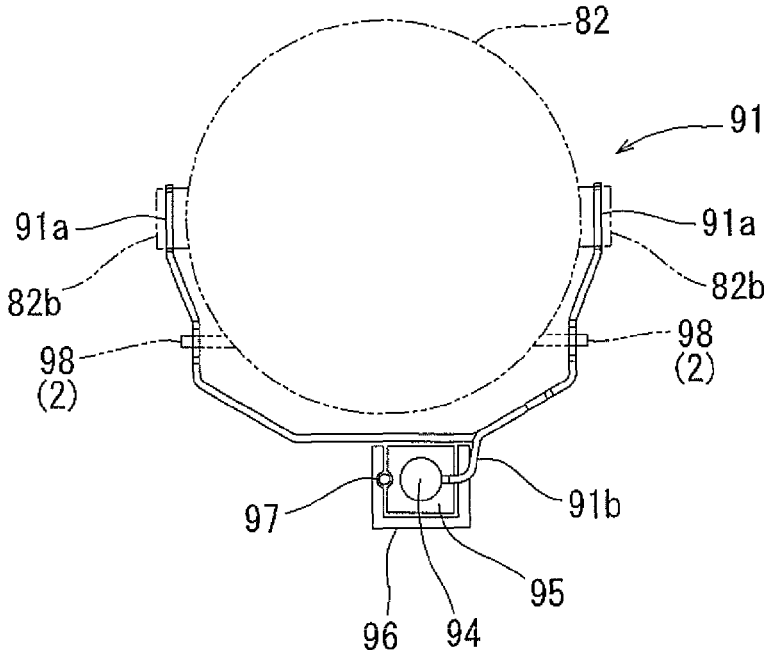
FIG. 18 is a front view of the reset mechanism.

The reset arm 91 is shown in FIG. 17 and FIG. 18. As shown in the drawings, the reset arm 91 has a substantially semicircular shape and is circumferentially disposed along a substantially lower half of the main body portion 2. The reset arm 91 includes a right and left pair of acting portions 91a and 91a that are respectively positioned at both ends thereof, an engagement portion 91 b that is positioned in a substantially central portion thereof, and a right and left pair of support apertures 91*c* and 91*c*. Support shafts 98 and 98 are attached to right and left side portions of the main body portion 2. The support shafts 98 and 98 are respectively inserted into the support apertures 91*c* and 91*c*, so that the reset arm 91 can be tilted back and forth via the support shafts 98 and 98.

As shown in FIG. 18, the engagement portion 91b of the reset arm 91 is positioned on a lower surface side of the main body portion 2. Upon back and forth movement of the engagement portion 91*b*, the reset arm 91 can be tilted back and forth.

The reset motor 92 is positioned on the lower surface side of the main body portion 2 and is encapsulated in the proximal portion of the handle portion 3. Rotational power of the reset motor 92 is reduced via a reducer head 93 and is then output. A threaded shaft 94 is attached to an output shaft 93*a* of the reducer head 93. An acting nut 95 is meshed with the threaded shaft 94. Upon actuation of the reset motor 92, the threaded shaft 94 rotates around an axis thereof, so that the acting nut 95 can move back and forth.

The acting nut 95 is supported by a support base 96. The support base 96 is positioned on a lower portion of the main body housing 2*a* and is attached to the proximal portion of the handle housing 3*a*, The support base 96 has guide rails 97 and 97 that longitudinally extend in parallel with each other. The acting nut 95 is supported by the right and left guide rails 97 and 97, so as to horizontally move back and forth over a desired range while it is prevented from being rotated around an axis thereof.

The engagement portion 91*b* of the reset arm 91 contacts a front side of the acting nut 95. Conversely, the lock ring 82 of the mode lock mechanism 80 has engagement projections 82*b* that are respectively formed in right and left portions thereof. Each of the engagement projections 82*b* and 82*b* is shaped to be laterally projected. The acting portions 91*a* and 91*a* of the reset arm 91 respectively contact front sides of the engagement projections 82*b* and 82*b* of the lock ring 82. As previously described, the lock ring 82 is biased forwardly (toward the locking position) by the compression spring 83. As a result, the acting portions 91*a* respectively contacting the front sides of the engagement projections 82*b* and 82*b* are biased forwardly due to indirect action of the compression spring 83. As a result of the fact that the right and left acting portions 91*a* and 91*a* are biased forwardly, the reset arm 91 is biased in a direction in which it is tilted clockwise in FIG. 15 about the support shafts 98 and 98, i.e., in a direction in which the engagement portion 91*b* is displaced rearwardly.

Figure 15:
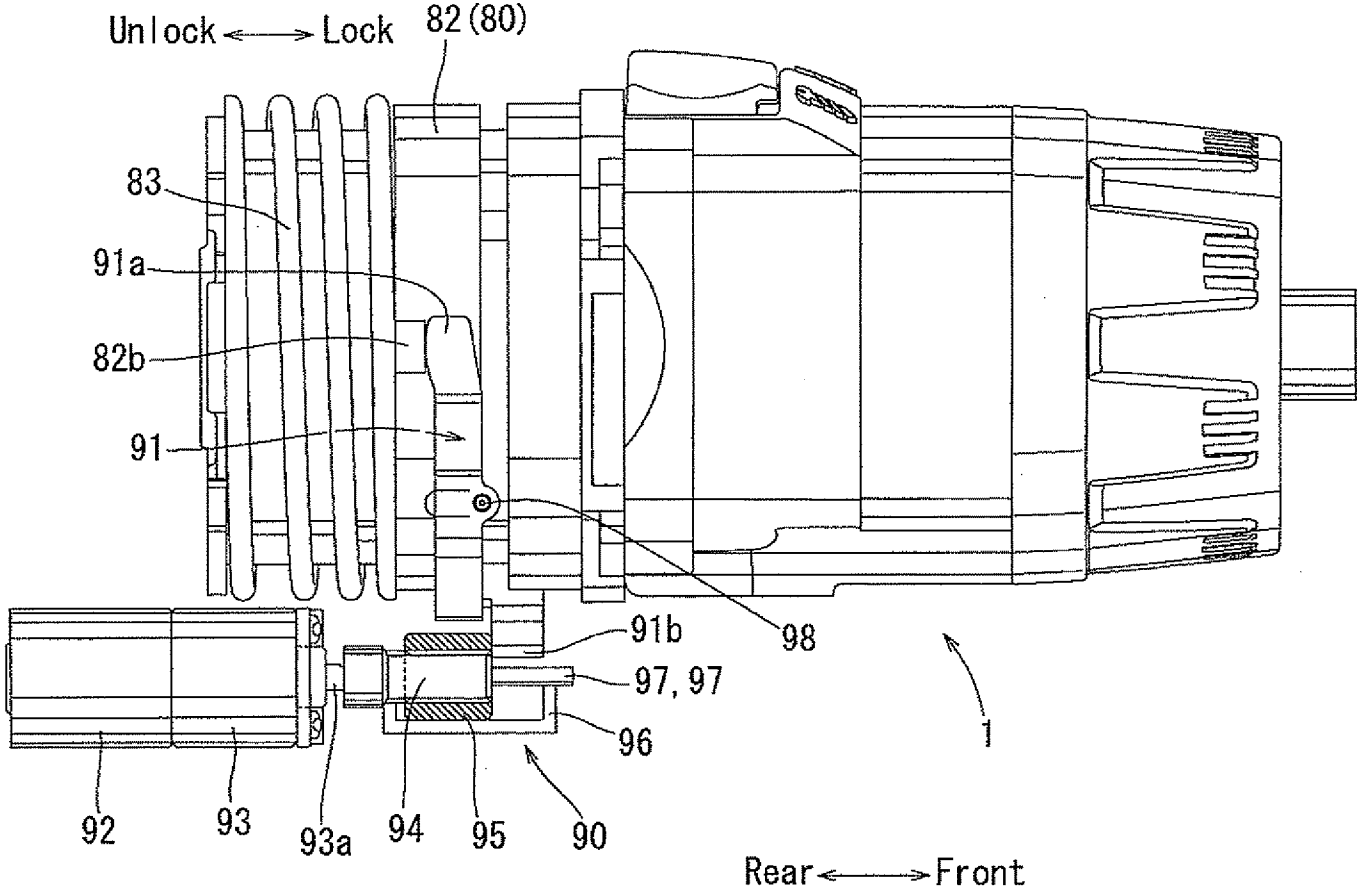
FIG. 15 is a side view of a reset mechanism contained in the mode lock mechanism according to the third embodiment. The view shows a condition in which a lock ring is positioned in a locking position.
Figure 16:
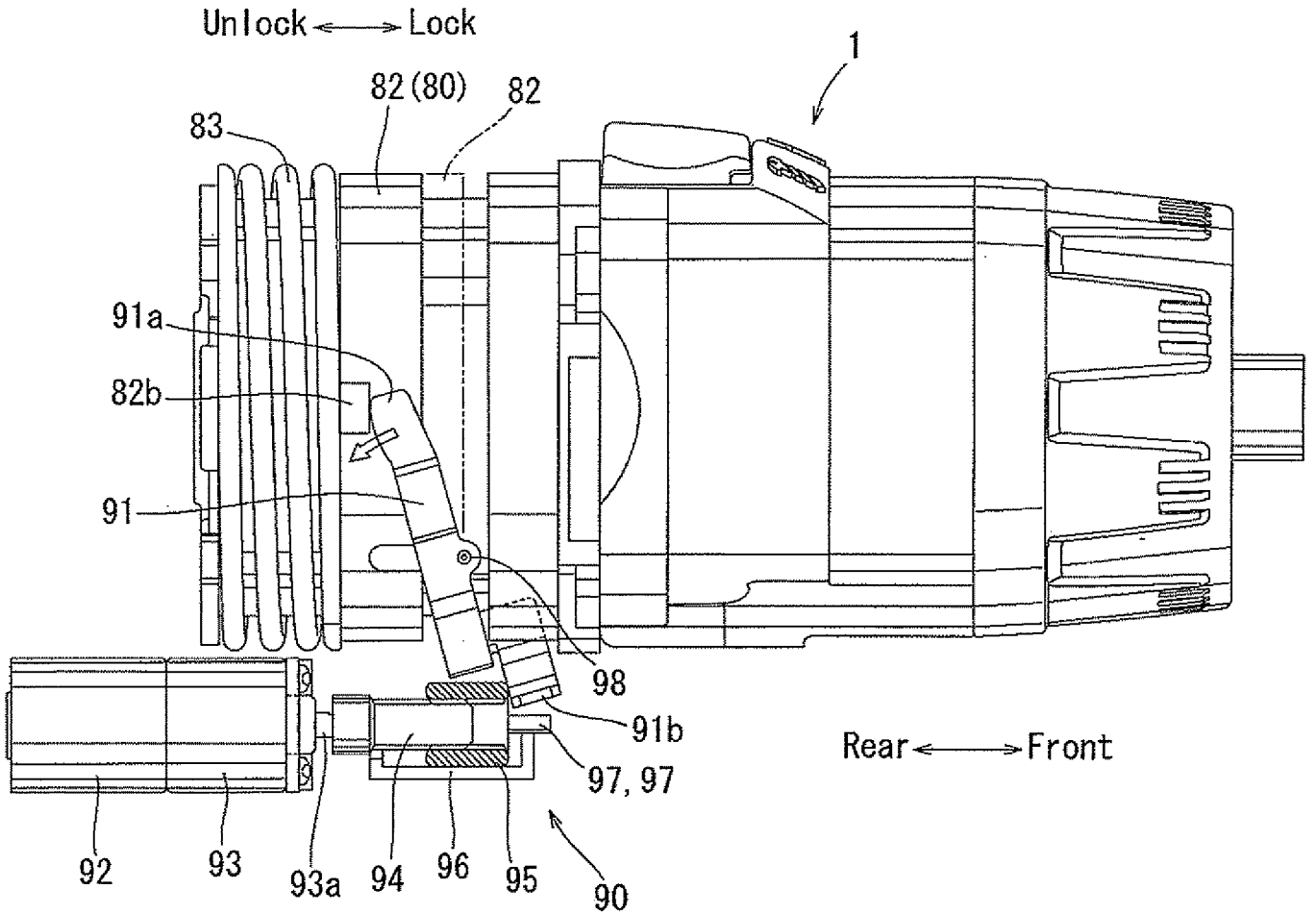
FIG. 16 is a side view of the reset mechanism contained in the mode lock mechanism according to the third embodiment. The view shows a condition in which the lock ring is returned to an unlocking position.

As shown in FIG. 15, when the lock ring 82 moves to the locking side by the biasing force of the compression spring 83, the reset arm 91 is tilted in a direction in which the acting portions 91*a* and 91*a* are displaced forwardly (toward the locking side). This tilting motion of the reset arm 91 toward the locking side is performed due to the fact that the acting nut 95 is reset to a condition in which it is returned to a rear side initial position.

To the contrary, when the acting nut 95 moves forwardly due to actuation of the reset motor 92, the engagement portion 91*b* is pressed forwardly, so that the reset arm 91 can be tilted in a direction in which the acting portions 91*a* and 91*a* are displaced rearwardly. When the right and left acting portions 91*a* and 91*a* are displaced rearwardly, the lock ring 82 can be reset to the unlocking side (toward an initial position) against the biasing force of the compression spring 83. Thus, the tilting motion of the reset arm 91 to a resetting side is performed against the indirect biasing force of the compression spring 83. Therefore, the forward displacement of the acting nut 95 due to the actuation of the reset motor 92 is performed against the indirect biasing force of the compression spring 83.

Thus, a reset to the initial condition (the high speed low torque mode) of the speed change device H can be automatically performed by the actuation of the reset motor 92. The reset motor 92 is incorporated into a control circuit of the electric motor 10, so as to be actuated with an off-operation of the switch lever 4. In this embodiment, the control circuit is constructed such that the reset motor 92 can be actuated after the elapse of a certain period of time after power feeding to the electric motor 10 is stopped by releasing a triggering operation of the switch lever 4 during an operation in the low speed high torque mode. When the operation in the low speed high torque mode is stopped as a result of the off-operation of the switch lever 4 by the user, the reset motor 92 can be actuated after the elapse of a certain period of time thereafter, so that the lock ring 82 can be returned to the rear side unlocking position. As a result, the second stage internal gear 34 is returned rearwardly, so that the operation modes of the main body portion 2 can be reset to the high speed low torque mode corresponding to the initial condition. Therefore, in the next screw tightening operation, the main body portion 2 can be actuated in the high speed low torque mode. Further, the control circuit is constructed such that the switch lever 4 is functionally disabled while the reset motor 92 is actuated.

Further, revolutions and rotation directions of the reset motor 92 are detected such that the reset motor 92 can be controlled by the detection results. After the off-operation of the switch lever 4, the reset motor 92 is actuated, so that the operation modes are returned to the high speed low torque mode. The rotational directions and the revolutions of the reset motor 92 are controlled such that the acting nut 95 can be moved forwardly over an appropriate distance. The forwardly moving distance of the acting nut 95 is set to be identical to a retracting distance of the lock ring 82 which is performed by the reset arm 91, i.e., a distance that is required to obtain the condition in which the engagement balls 81 to 81 are not projected to the inner circumferential side from the holding holes 2*c*. The forwardly moving distance of the acting nut 95 is detected based on the rotation directions and the revolutions of the reset motor 92, and the reset motor 92 can be inverted (reversed) based on the moving distance.

When the acting nut 95 is advanced over the required distance and the lock ring 82 is retracted, the engagement balls 81 to 81 are shifted to the deepest portion of the cam surface 82*a* by the biasing force of the compression spring 35 that can be indirectly applied thereto via the second stage internal gear 34. As a result, the second stage internal gear 34 is retracted, so that the operation modes can be reset to the high speed low torque mode. Because a retracted position of the second stage internal gear 34 can be maintained by the compression spring 35, the lock ring 82 can be maintained in the rear side locking position against the compression spring 83. Thus, even when the reset motor 92 is reversed to retract the acting nut 95 after the operation modes are reset to the initial condition, the reset arm 91 can be maintained in a position shown in FIG. 15. The reset motor 92 detects an advancing distance of the acting nut 95 based on the revolutions thereof. Thereafter, the reset motor 92 is reversed by a certain number of revolutions, so as to move the acting nut 95 rearwardly. Therefore, in the next use, the speed change device H can be actuated in the initial condition (the high speed low torque mode).

According to the mode lock mechanism 80 having the reset mechanism 90 thus constructed, the lock ring 82 is returned to the rear side unlocking position by the reset motor 92. As a result, the second stage internal gear 34 is returned rearwardly, so that the operation modes can be reset to the high speed low torque mode (the initial condition). Thus, the exemplified reset mechanism 90 is constructed such that the lock ring 82 can be returned by the reset motor 92 that is provided separately from the switch lever 4. Therefore, operability of the switch lever 4 cannot be impaired. To the contrary, in a case in which motion of the switch lever 4 toward an off position is utilized via a link arm or other such mechanisms in order to return the lock ring 82 to the rear side unlocking position against the compression spring 83, it is necessary to sufficiently increase a return force of the switch lever 4. Therefore, it is necessary to apply a large triggering force to the switch lever 4. As a result, the operability of the switch lever 4 can be reduced.

Further, because the lock ring 82 is returned by the reset motor 92 that is provided separately from the switch lever 4, the timing to return the lock ring 82 relative to the timing of the off-operation of the switch lever 4 can be easily appropriately determined by appropriately controlling the reset motor 92. When the timing to return the operation modes to the initial condition is set to a point of time after the elapse of a certain period of time after the electric motor 4 is stopped, the clutch teeth 34*a* to 34*a* of the second stage internal gear 34 can be meshed with the clutch teeth 23*a* to 23*a* after the first stage carrier 23 is completely stopped. Therefore, the second stage internal gear 34 can be prevented from being returned rearwardly during idle rotation of the first stage carrier 23, so that the clutch teeth 23*a* to 23*a* of the first stage carrier 23 can be avoided from contacting the clutch teeth 34*a* to 34*a* of the second stage internal gear 34 during the idle rotation of the first stage carrier 23. As a result, the speed change device H can be avoided from being reduced in durability.

Figure 19:
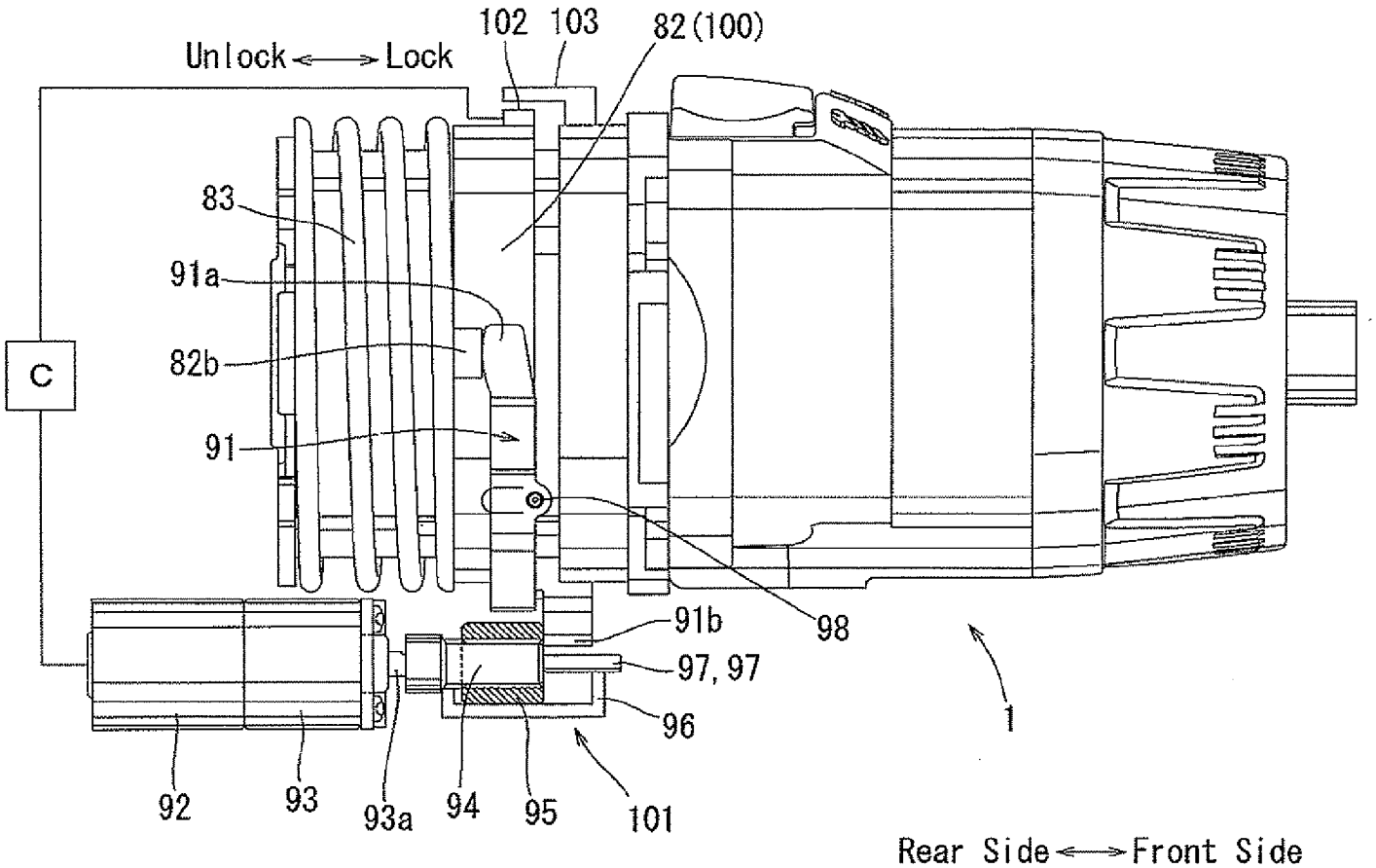
FIG. 19 is a side view of a reset mechanism contained in a mode lock mechanism according to a fourth embodiment. The view shows a condition in which a lock ring is positioned in a locking position that is positioned in a front side.
Figure 20:
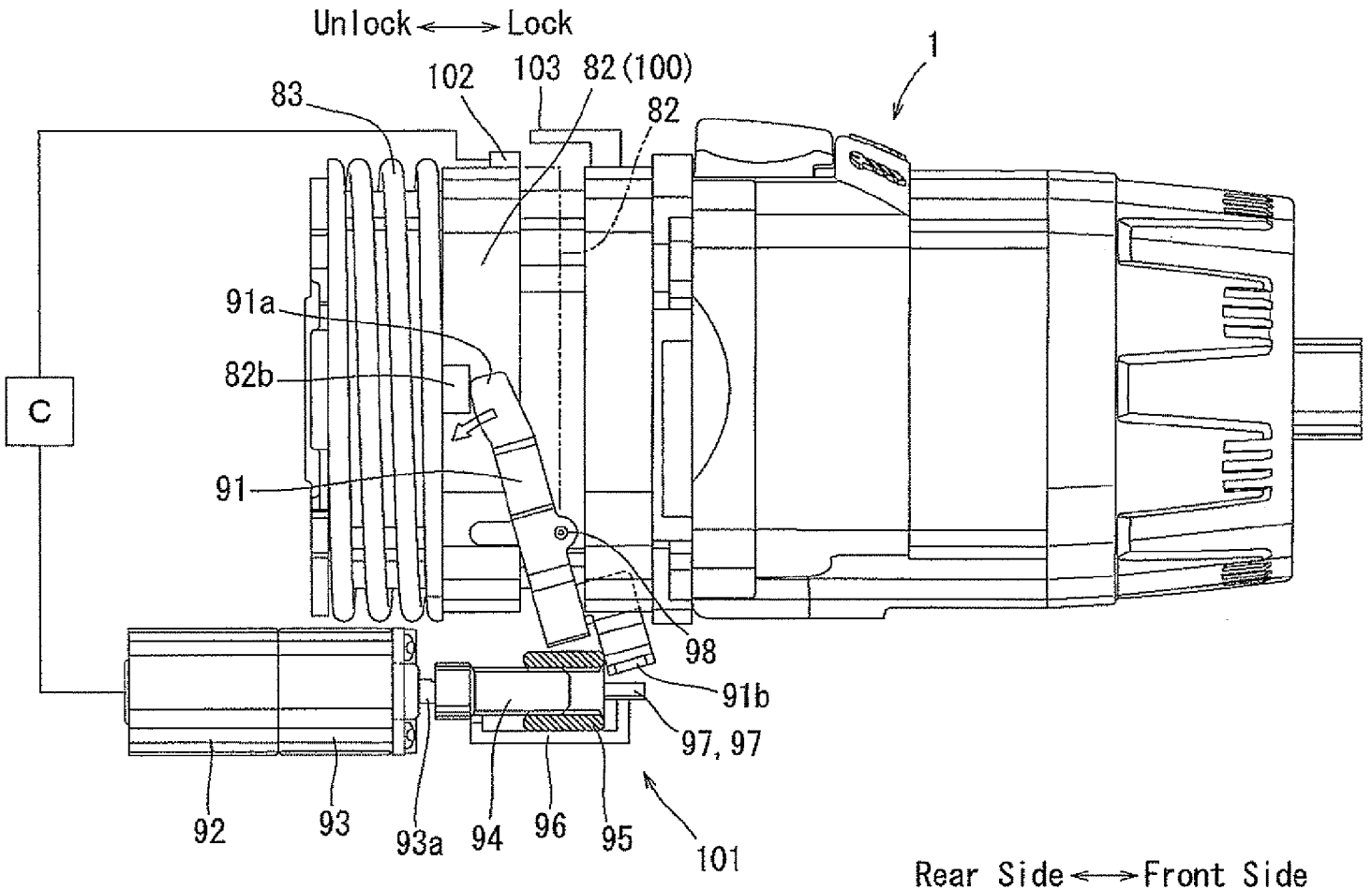
FIG. 20 is a side view of the reset mechanism contained in the mode lock mechanism according to the fourth embodiment. The view shows a condition in which the lock ring is returned to an unlocking position that is positioned in a rear side.
Figure 21:
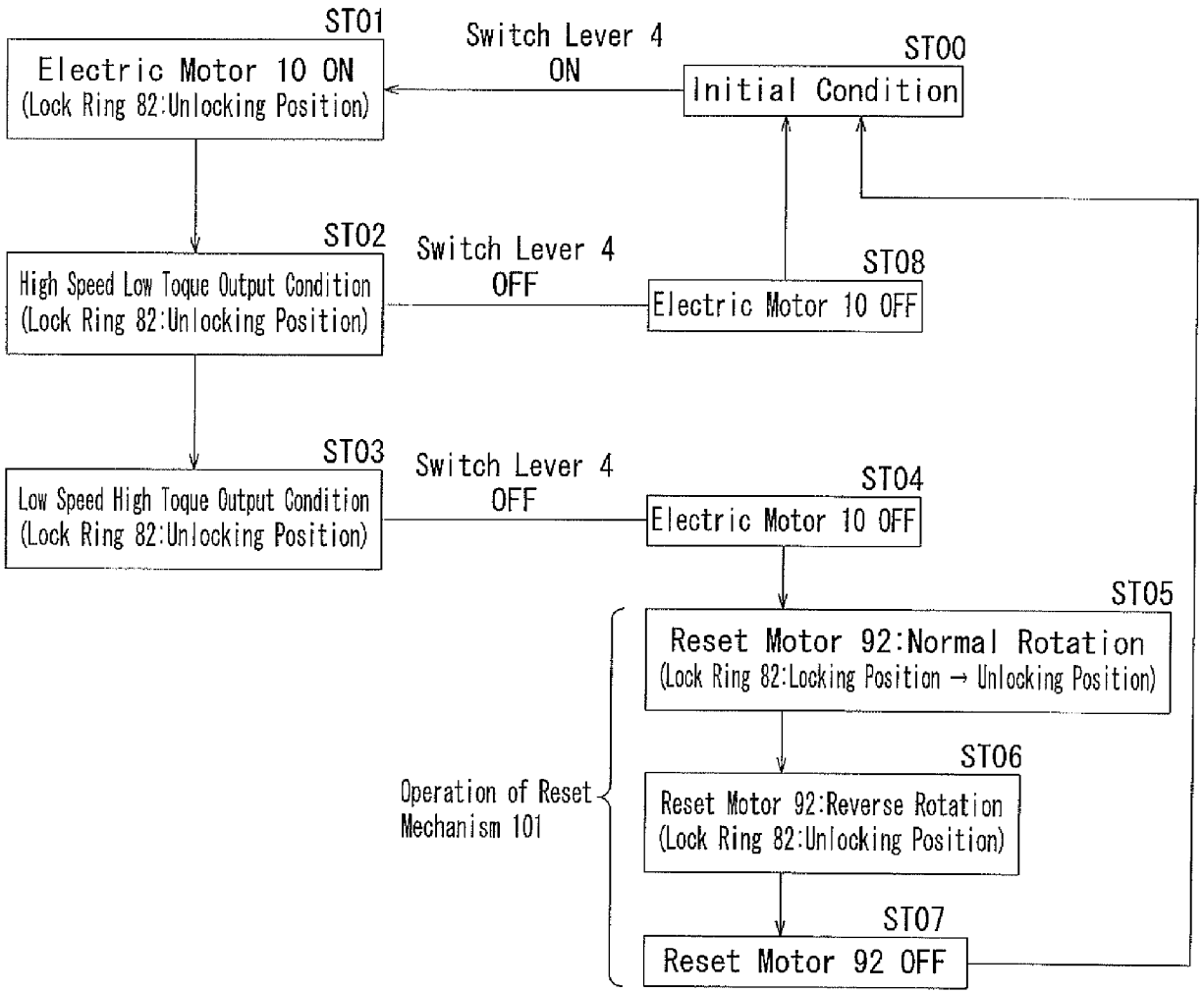
FIG. 21 is a flow chart, illustrating an operational flow of the reset mechanism contained in the mode lock mechanism according to the fourth embodiment.

FIGS. 19 to 21 show a mode lock mechanism 100 according to a fourth embodiment. The mode lock mechanism 100 according to the fourth embodiment includes a reset mechanism 101 that is modified from the reset mechanism 90. The mode lock mechanism 100 according to the fourth embodiment is characterized by the reset mechanism 101. Therefore, constructions and elements that are the same as of the third embodiment will be identified by the same reference numerals and a detailed description of such constructions and elements may be omitted.

The reset mechanism 101 of the mode lock mechanism 100 according to the fourth embodiment is constructed to be actuated only when the speed change device H is switched to the low speed high torque mode.

As shown in FIGS. 19 and 20, the lock ring 82 has a magnetic sensor 102 that is attached to an outer circumference thereof. Conversely, a detector plate 103 made of a steel plate is attached to the main body housing 2*a*. A position (the locking position or the unlocking position) of the lock ring 82 is detected by the magnetic sensor 102. As shown by solid lines in FIG. 20, in the high speed low torque output condition in which the lock ring 82 is positioned in the rear side unlocking position, the magnetic sensor 102 is displaced from a position below the detector plate 103, so as to be shifted to an off-condition. To the contrary, as shown in FIG. 19, in the low speed high torque output condition in which the lock ring 82 is displaced to the front side locking position as a result of increase of the load torque applied to the spindle 11, the magnetic sensor 102 moves to the position below the detector plate 103, so that the magnetic sensor 102 can be turned on. An on-signal of the magnetic sensor 102 is output to a reset control circuit C.

In addition to the on-signal of the magnetic sensor 102 described above, an information signal representative of the off-operation of the switch lever 4 (the stoppage of the electric motor 10). Thus, the reset mechanism 101 can be actuated based upon the output condition of the speed change device H and the operating condition of the electric motor 10. In the fourth embodiment, the reset control circuit C is constructed such that the reset mechanism 101 can be actuated only in a condition in which the speed change device H is switched to the low speed high torque output condition. An operational flow of the reset mechanism 101 is shown in FIG. 21.

In the initial condition of the speed change device H and in a stopped condition of the electric motor 10, the acting nut 95 is retracted and is positioned in a condition in which the acting nut 95 does not press the reset arm 91 toward the resetting side (in a direction to move the acting portions 91*a* rearwardly) (which condition corresponds to an initial condition of the reset mechanism 101) [Step (which will be hereinafter referred to as ST) 00]. In the high speed low torque output condition of the speed change device H just after the electric motor 10 is actuated by the triggering operation of the switch lever 4, the lock ring 82 is held in the rear side unlocking position, so that the acting nut 95 can still be retained in a retracted position [ST01 and ST02]. In ST00 to ST02, because the lock ring 82 is held in the unlocking position, the magnetic sensor 102 is displaced from the position below the detector plate 103. Therefore, the on-signal of the magnetic sensor 102 is not input to the reset control circuit C.

When the speed change device H is switched from the high speed low torque output condition to the low speed high torque output condition as a result of the fact that the load torque applied to the spindle 11 is increased after the screw tightening operation or the drilling operation is progressed [ST03], as shown in FIG. 19, the lock ring 82 is displaced to the front side locking position by the compression spring 83. As a result, the magnetic sensor 102 is displaced to the position below the detector plate 103. The magnetic sensor 102 can output the on-signal to the reset control circuit C when it is displaced to the position below the detector plate 103.

When the triggering operation of the switch lever 4 is released (the off-operation) in an on-condition of the magnetic sensor 102 in the high speed low torque output condition, the electric motor 10 is stopped [ST04]. When the on-signal of the magnetic sensor 102 and the stop signal of the electric motor 10 are input in the reset control circuit C, the reset motor 92 is actuated in a normal rotation direction, so that the reset mechanism 101 is actuated [ST05]. As shown in FIG. 20, when the reset motor 92 is actuated in the normal rotation direction, the acting nut 95 moves forwardly, so that the engagement portion 91*b* is pressed forwardly. When the engagement portion 91*b* is pressed forwardly, the reset arm 91 can be tilted toward the resetting side about the support shafts 98 and 98 (in the direction in which the acting portions 91*a* and 91*a* are displaced rearwardly). When the reset arm 91 is tilted toward the resetting side, the engagement projections 82*b* and 82*b* are pressed rearwardly by the engagement portion 91*b* and 91*b*, so that the lock ring 82 can move to the rear side unlocking position against the compression spring 83. When the lock ring 82 is returned to the unlocking position, each of the engagement balls 81 can be displaced to an unlocking position in which it is not projected into the main body housing 2*a*. As a result, the second stage internal gear 34 is returned to a rear side initial position (a position in which the clutch teeth 34*a* can be meshed with the clutch teeth 23*a*) by the biasing force of the compression spring 35.

Thus, the second stage internal gear 34 is returned rearwardly, so that the operation modes of the main body portion 2 can be automatically reset to the high speed low torque mode corresponding to the initial condition. Therefore, in the next drilling or screw tightening operation, the electrical power tool 1 can be actuated in the initial condition of the speed change device H (the high speed low torque mode).

Further, when the lock ring 82 is returned to the unlocking position, because the magnetic sensor 102 is retracted rearwardly from the position below the detector plate 103, the on-signal of the magnetic sensor 102 is not input to the reset control circuit C. When detected rotational directions and revolutions of the acting nut 95 show that the lock ring 82 is returned to the unlocking position and the speed change device H is returned to the initial condition, the reset motor 92 is reversed, so that the acting nut 95 is retracted rearwardly [ST06]. When the detected rotational directions and revolutions of the reset motor 92 show that the acting nut 95 is retracted rearwardly, the reset motor 92 is deactuated [ST07]. Thus, a sequence of actions of the reset mechanism 101 can be completed [ST00]. Further, the reset control circuit C and the control circuit of the electric motor 10 are constructed such that the electric motor 10 cannot be actuated even if the switch lever 4 is triggered while the reset motor 92 is actuated.

Conversely, for example, when the electrical power tool 1 is tentatively rotated and is then temporarily stopped in order to check a power feeding condition of the electrical power tool 1, rotational directions of the spindle 11 or other such conditions, the speed change device H is maintained in the high speed low torque condition. Therefore, the reset mechanism 101 cannot be actuated. In this case, as shown in FIG. 21, the switch lever 4 is triggered in the initial condition [ST00], so as to actuate the electric motor 10 [ST01]. Because this step is in the no load condition, the speed change device H can be operated in the high speed low torque output condition [ST02]. In the high speed low torque output condition, because the lock ring 82 is retained in the rear side unlocking position, the magnetic sensor 102 is not activated. Therefore, the on-signal of the magnetic sensor 102 cannot be input to the reset control circuit C. When the triggering operation of the switch lever 4 is released while the on-signal of the magnetic sensor 102 is not input to the reset control circuit C, the electric motor 10 is stopped. However, the reset mechanism 101 cannot be actuated. Thus, operations and controls corresponding to ST05 to ST07 can be omitted, so that the electrical power tool 1 can be more quickly returned to the initial condition [ST00].

According to the electrical power tool 1 having the speed change device H thus constructed, the reset mechanism 101 for releasing the locked condition of the mode lock mechanism 100 and returning the device to the initial condition can be actuated only when the speed change device H is switched to the low speed high torque output condition. That is, the reset mechanism 101 cannot be actuated when the speed change device H is maintained in the high speed low torque condition. Therefore, for example, when the electrical power tool 1 is operated (tentatively rotated) in the no load condition in order to check the power feeding condition of the electrical power tool 1 or the rotational directions of the bit, the reset mechanism 101 is not actuated. Therefore, it is possible to omit the sequence of actions of the reset mechanism 101, e.g., reciprocating motion of the acting nut 95 produced by normal rotation and reverse rotation of the reset motor 92, tilting motion of the reset arm 91 caused by the reciprocating motion of the acting nut 95 and additional motions. Thus, the electrical power tool 1 can be quickly restarted (the electric motor 10 can be quickly actuated) immediately after it is tentatively rotated, so as to be utilized in actual work.

Various modifications may be made to the embodiment described above. For example, exemplified is the structure in which the lock ring 82 moved to the locking position is detected by the magnetic sensor 102. However, a microswitch, a reflective photosensor or other such sensors can be used.

Further, instead of the electric control device using the sensor and the reset control circuit C, a mechanical device using a lever member or other similar members can be used to detect the lock ring moved to the locking position in order to actuate the reset mechanism.

Further, each of the exemplified reset mechanisms 90 and 101 can be applied to a speed change device not having the third stage planetary gear train 40.

The invention claimed is:

1. An electrical power tool comprising an electric motor operated by a triggering operation of the switch lever; and a speed change device for decelerating rotative power of the electric motor and outputting the same to a spindle, wherein the speed change device has a first stage planetary gear train positioned in an upstream side of a power transmission pathway, a second stage planetary gear train positioned in a downstream side of the power transmission pathway, and an internal restriction member capable of preventing an internal gear of the second stage planetary gear train from being rotated about an axis, wherein the speed change device is constructed such that when an external torque applied to the spindle is increased, an initial condition in which the internal gear is allowed to rotate so that a high speed low torque is output to the spindle can be automatically switched to a condition in which the internal gear is prevented from rotating by the internal restriction member so that a low speed high torque is output to the spindle, wherein the speed change device includes a mode lock mechanism that is capable of maintaining the automatically switched low speed high torque output condition regardless of changes of the external torque, and a reset mechanism that is capable of releasing the mode lock mechanism such that operation modes can be returned to the initial condition, and wherein the reset mechanism is actuated by an actuator that is provided separately from the switch lever as a drive source.

2. The electrical power tool as defined in claim 1, wherein the mode lock mechanism comprises a lock ring that is capable of locking the internal restriction member in a restriction position, and a biasing device biasing the lock ring toward a locking side, wherein the reset mechanism comprises a reset arm that is capable of returning the lock ring to an unlocking side against the biasing device, and wherein the reset arm is moved toward a resetting side by a reset motor, the actuator that is provided as the drive source.

3. The electrical power tool as defined in claim 2, wherein the reset motor is actuated after the elapse of a certain period of time after the electric motor is stopped by an off-operation of the switch lever.

4. The electrical power tool as defined in claim 1, wherein the mode lock mechanism comprises a lock ring that is capable of moving toward a locking position when the speed change device is switched to the low speed high torque output condition, and wherein the reset mechanism can be actuated only in a condition in which the lock ring is positioned in the locking position.

5. The electrical power tool as defined in claim 4, wherein a position of the lock ring is detected by a sensor, so that the reset mechanism can be actuated based upon an output signal of the sensor.

* * * * *